US007370955B2

(12) United States Patent
Yokoyama et al.

(10) Patent No.: US 7,370,955 B2
(45) Date of Patent: May 13, 2008

(54) INKJET PRINTER

(75) Inventors: Takeshi Yokoyama, Hachioji (JP); Koji Matsushima, Hachioji (JP)

(73) Assignee: Konica Minolta Holdings, Inc., Tokyo (JP)

( * ) Notice: Subject to any disclaimer, the term of this patent is extended or adjusted under 35 U.S.C. 154(b) by 299 days.

(21) Appl. No.: 10/537,712

(22) PCT Filed: Dec. 12, 2003

(86) PCT No.: PCT/JP03/15979

§ 371 (c)(1),
(2), (4) Date: Jun. 3, 2005

(87) PCT Pub. No.: WO2004/054810

PCT Pub. Date: Jul. 1, 2004

(65) Prior Publication Data

US 2006/0023045 A1 Feb. 2, 2006

(30) Foreign Application Priority Data

Dec. 13, 2002 (JP) ..... 2002-362760

(51) Int. Cl.
*B41J 2/01* (2006.01)

(52) U.S. Cl. ..... 347/102; 347/100

(58) Field of Classification Search ..... 347/95, 347/100, 101, 102, 103
See application file for complete search history.

(56) References Cited

U.S. PATENT DOCUMENTS 6,232,361 B1 * 5/2001 Laksin et al. ..... 522/84
2003/0035037 A1 * 2/2003 Mills et al. ..... 347/102

FOREIGN PATENT DOCUMENTS

| | | | |
|---|---|---|---|
| JP | 60-132767 | A | 7/1985 |
| JP | 10-296906 | A | 11/1998 |
| JP | 2000-135781 | A | 5/2000 |
| JP | 2000-198185 | A | 7/2000 |
| JP | 2001-310454 | A | 11/2001 |
| JP | 2002-197727 | A | 7/2002 |
| JP | 2002-248750 | A | 9/2002 |

OTHER PUBLICATIONS

Notification of Transmittal of Copies of Translation of the International Preliminary Report on Patentability, Chapter I or Chapter II of the Patent Cooperation Treaty for PCT/JP2003/015979, 5 sheets.

* cited by examiner

*Primary Examiner*—Matthew Luu
*Assistant Examiner*—Henok Legesse
(74) *Attorney, Agent, or Firm*—Frishauf, Holtz, Goodman & Chick, P.C.

(57) ABSTRACT

The ultraviolet ray irradiation device 9 comprises the cover member 16 to cover the ultraviolet ray light source 15, and an ultraviolet ray reflectance of a surface which is an inner surface of the cover member 16 and reflects the ultraviolet ray radiated from the ultraviolet ray light source 15 to the recording head 6 is made to be lower than an ultraviolet ray reflectance of the other surface.

20 Claims, 17 Drawing Sheets

INKJET PRINTER

This application is a U.S. National Phase Application under 35 USC 371 of International Application PCT/JP2003/015979 filed Dec. 12, 2003.

FIELD OF THE INVENTION

The present invention relates to an inkjet printer, and more particularly to an inkjet printer curing ink by radiating an ultraviolet ray to the ink to form an image.

BACKGROUND ART

As an inkjet printer, in recent years, an inkjet printer including a recording head provided with nozzles for jetting ink, which is cured by being irradiated with an ultraviolet ray, and an ultraviolet ray irradiation device radiating the ultraviolet ray to cure the ink has been used.

Here, if a time after the ink has landed on a recording medium till the ultraviolet ray is radiated thereon is long, the diameter of the dot of the ink which has landed on the recording medium is expanded. Then, the generation of a blur and a mixture of colors arise to lower an image quality. Accordingly, in order to shorten the time after the ink has landed on the recording medium till the ultraviolet ray is radiated, in a conventional inkjet printer, the ultraviolet ray irradiation device equipped with a cover member covering a light source is provided in close vicinity to the recording head (JP-Tokukaisyou-60-132767: hereinafter referred to as Patent Document 1).

However, in the conventional inkjet printer (Patent Document 1), some ultraviolet rays radiated from the ultraviolet ray light source are reflected on the inner surface of the cover member covering the light source, the surface of the recording medium and the like, and the reflected ultraviolet rays have reached the recording head. For example, as shown in FIG. 17, as for an ultraviolet ray which has radiated from an ultraviolet ray light source 15 and has been reflected on a surface of a cover member 16 which is perpendicular to a recording medium 17, an incident angle R thereof to the surface of the recording medium 17 is large, and a reflection angle r thereof on the surface of the recording medium 17 is also large. Consequently, it is easy for the reflected ultraviolet ray to pass through a space between the cover member 16 and the recording medium 17 to enter a recording head 6.

In this case, there is the following problem. That is, the ultraviolet ray is radiated on the ink adhering to a nozzle surface, which is a surface on which the nozzle of the recording head is provided, and on the ink in the nozzle, and consequently the ink is bodied or cured to generate imperfect jetting. In particular, as the ink to be cured by the ultraviolet ray, there are known a radical polymerization series ink and a cationic polymerization series ink. Among them, since the cationic polymerization series ink does not receive the inhibition of polymerization by oxygen, which the radical polymerization series ink receives, the sensitivity of the cationic polymerization series ink is high, and also the cationic polymerization series ink has a property of the acids belonging to active species of accumulating light energy. Consequently, when the ultraviolet ray is radiated on the ink adhering on the nozzle surface or on the ink in the nozzle in a case of using the cationic polymerization series ink, the imperfect jetting of the ink is easy to be produced.

DISCLOSURE OF THE INVENTION

It is an object of the present invention to provide an inkjet printer capable of decreasing the amount of ultraviolet ray reaching a nozzle surface by reflection while securing the necessary and sufficient amount of ultraviolet rays in order to cure the ink which has landed on a recording medium for preventing the bodying and the curing of the ink to stably jet the ink.

To solve the above problem, in accordance with the first aspect of the present invention, the inkjet printer comprises:

a recording head provided with a nozzle to jet ink which is cured by radiation of an ultraviolet ray; and an ultraviolet ray irradiation device provided with an ultraviolet ray light source to generate the ultraviolet ray to cure the ink, wherein the ink is cured by radiating the ultraviolet ray to a recording medium with the ultraviolet ray irradiation device after making the ink jetted from the nozzle land on the recording medium to form an image, the ultraviolet ray irradiation device comprises a cover member to cover the ultraviolet ray light source, and an ultraviolet ray reflectance of a surface which is in the cover member and reflects the ultraviolet ray radiated from the ultraviolet ray light source to the recording head is made to be lower than an ultraviolet ray reflectance of the other surface.

According to the first aspect of the present invention, the ultraviolet ray reflectance of the surface which is an inner surface of the cover member and reflects the ultraviolet ray radiated from the ultraviolet ray light source to the recording head is made to be lower than those of the other surfaces. Consequently, the ultraviolet ray reflected on the surface which is the inner surface of the cover member and reflects the ultraviolet ray radiated from the ultraviolet ray light source to the recording head becomes an ultraviolet ray having decreased energy and reaches the recording head. On the other hand, the ultraviolet rays reflected on a surface other than the surface which is the inner surface of the cover member and reflects the ultraviolet ray radiated from the ultraviolet ray light source to the recording head is radiated on the surface of the recording medium with the energy higher than that of the ultraviolet ray reflected on the surface reflecting the ultraviolet ray to the recording head. Consequently, it is possible to decrease the amount of the ultraviolet ray reaching the nozzle surface by reflection while securing the necessary and sufficient amount of the ultraviolet rays in order to cure the ink which has landed on the recording medium for preventing the bodying and the curing of the ink to stably jet the ink.

Moreover, since the amount of the ultraviolet rays reaching the nozzle surface by reflection can be decreased, it is possible to arrange the ultraviolet ray irradiation device and the recording head in close vicinity to each other, and to miniaturize the inkjet printer.

A reflection member to reflect the ultraviolet ray may be provided on an inner surface of a surface of the cover member which is perpendicular to the recording medium and is in close vicinity to the recording head.

According to the invention, the reflection member reflecting the ultraviolet ray is provided on the inner surface of the surface of the cover member which is perpendicular to the recording medium and is in close vicinity to the recording head. Thereby, the ultraviolet ray is reflected by the reflection member to be effectively radiated to the surface of the recording medium. Since the ultraviolet ray which has entered the surface of the recording medium advances in the opposite direction to the recording head even if the ultraviolet ray is reflected on the surface of the recording medium, there are no chances for the ultraviolet ray to reach the recording head as it is. Consequently, it is possible to prevent the bodying or the curing of the ink to stably jet the ink while efficiently securing the necessary and sufficient amount of the ultraviolet rays in order to cure the ink which has landed on the recording medium.

An ultraviolet ray absorbing member to absorb the ultraviolet ray may be provided on an inner surface of a surface of the cover member which is perpendicular to the recording medium and is distant from the recording head.

According to the invention, the ultraviolet ray absorbing member absorbing the ultraviolet ray is provided on the inner surface of the surface of the cover member which is perpendicular to the recording medium and is distant from the recording head. Thereby, the ultraviolet ray which has entered the surface is absorbed by the surface and the energy thereof is decreased. That is, the ultraviolet ray entering the recording head after being reflected is absorbed by the ultraviolet ray absorbing member, and the energy thereof is decreased. But, the ultraviolet ray which does not enter the recording head even if it is reflected is radiated to the surface of the recording medium with high energy. Consequently, it is possible to decrease the amount of the ultraviolet rays reaching the nozzle surface by reflection for preventing the bodying and the curing of the ink to stably jet the ink while securing the necessary and sufficient amount of the ultraviolet rays in order to cure the ink which has landed on the recording medium.

A partition member to partition an inside of the cover member may be provided in the cover member.

According to the invention, since some ultraviolet rays which would be reflected on the cover member or the like and reach the recording head if there were no partition member can be blocked off by the partition member, the amount of the ultraviolet rays reaching the recording head is decreased. Consequently, it is possible to prevent the bodying and the curing of the ink by reflection to stably jet the ink while securing the necessary and sufficient amount of the ultraviolet rays in order to cure the ink which has landed on the recording medium.

Preferably, an ultraviolet absorbing member to absorb the ultraviolet ray is provided on a surface of the partition member which is perpendicular to the recording medium and is on a side of the recording head, and a reflection member reflecting the ultraviolet ray is provided on a surface of the partition member which is perpendicular to the recording medium and is distant from the recording head.

According to the invention, the ultraviolet ray which has entered the surface provided with the ultraviolet ray absorbing member is absorbed by the ultraviolet ray absorbing member, and the energy of the ultraviolet ray is decreased. On the other hand, the ultraviolet ray which has entered the surface on which the reflection member is provided is reflected by the reflection member, and is effectively radiated on the surface of the recording medium. Consequently, it is possible to decrease the amount of the ultraviolet rays reaching the nozzle surface by reflection for preventing the bodying and the curing of the ink to stably jet the ink while securing the necessary and sufficient amount of the ultraviolet rays in order to cure the ink which has landed on the recording medium.

A plurality of ultraviolet ray light sources may be provided in the ultraviolet ray irradiation device.

According to the invention, since the plurality of ultraviolet ray light sources are provided, the amount of the ultraviolet rays radiated on the recording medium is increased, and the ink which has landed on the recording medium is cured in a short time. Consequently, a good image can be formed.

Preferably, the ultraviolet ray light source is any one of a high pressure mercury lamp, a metal halide lamp, a hot-cathode tube, a cold-cathode tube and an LED.

According to the invention, the ultraviolet ray light source is composed of any one of the high pressure mercury lamp, the metal halide lamp, the hot-cathode tube, the cold-cathode tube and the LED. Even in this case, since the ultraviolet ray reflectance of the surface which is the inner surface of the cover member and reflects the ultraviolet ray radiated from the ultraviolet ray light source to the recording head is made to be lower than those of the other surface, the ultraviolet ray reflected on the surface which is the inner surface of the cover member and reflects the ultraviolet ray radiated from the ultraviolet ray light source to the recording head becomes to one having decreased energy, and reaches the recording head. That is, the amount of the ultraviolet rays reaching the nozzle surface by reflection can be decreased.

Preferably, the ink is a cation curing type ink.

According to the invention, since the ultraviolet ray reflectance of the surface which is the inner surface of the cover member and reflects the ultraviolet ray radiated from the ultraviolet ray light source to the recording head is made to be lower than those of the other surfaces, the ultraviolet ray reflected on the surface which is the inner surface of the cover member and reflects the ultraviolet ray radiated from the ultraviolet ray light source to the recording head becomes to one having decreased energy, and reaches the recording head. Consequently, even if the ink is cation curing type ink, the reaction of the ink with the ultraviolet rays on the nozzle surface and in the jet opening of the nozzle surface is prevented, and the amount of the accumulation of ultraviolet ray energy is decreased.

Moreover, since the cation curing type ink does not receive an oxygen inhibition operation, by radiating the ultraviolet ray to the ink which has landed on the recording medium, it is possible to cure the ink in a short time, and it is possible to form a good quality image.

The recording head may be a serial head system, and the ultraviolet ray irradiation device may be provided at least on one side of both side portions of the recording head in a main scanning direction thereof.

According to the invention, since the ultraviolet ray irradiation device is provided at least on the one side of the both side portions of the recording head in the main scanning direction thereof, by performing a reciprocating movement of the recording head and the ultraviolet ray irradiation device, the ultraviolet ray is radiated to the ultraviolet ray curing ink which has been jetted from the nozzle of the recording head and has landed on the recording medium. At this time, since the ultraviolet ray reflectance of the surface which is the inner surface of the cover member and reflects the ultraviolet ray to the recording head is made to be lower than those of the other surfaces, the ultraviolet ray reflected on the surface which is the inner surface of the cover member and reflects the ultraviolet ray to the recording head becomes one having decreased energy to reach the recording head. Consequently, the bodying and the curing of the ink can be prevented, and the ink can be stably jetted.

The recording head may be a line scan head system, and the ultraviolet ray irradiation device may be provided on a downstream side of the recording head in a direction in which the recording medium is conveyed.

According to the invention, since the ultraviolet ray irradiation device is provided on the downstream side in the direction in which the recording medium of the recording head is conveyed, the ultraviolet ray is radiated on the ultraviolet ray curing ink which has been jetted from the recording head and has landed on the recording medium by the movement of the recording medium. At this time, since the ultraviolet ray reflectance of the surface which is the inner surface of the cover member and reflects the ultraviolet ray to the recording head is made to be lower than those of the other surfaces, the ultraviolet ray reflected on the surface which is the inner surface of the cover member and reflects the ultraviolet ray to the recording head becomes one having decreased energy to reach the recording head. Consequently, the bodying and the curing of the ink can be prevented, and the ink can be stably jetted.

In accordance with the second aspect of the present invention, the inkjet printer comprises:

a recording head to jet ink from a jet opening of a nozzle toward a recording medium, the ink being cured by irradiated with an ultraviolet ray; and an ultraviolet ray irradiation device to radiate the ultraviolet ray from an ultraviolet ray light source to the ink jetted on the recording medium, wherein the ultraviolet ray irradiation device comprises a cover member to cover the ultraviolet ray light source;

the cover member is opened toward a recording surface side of the recording medium, and comprises an orthogonal surface portion approximately perpendicular to the recording surface and an opposite surface portion having a region opposed to at least the recording surface; and an ultraviolet ray reflectance of the orthogonal surface portion is made to be lower than an ultraviolet ray reflectance of the opposite surface portion.

According to the second aspect of the present invention, the ultraviolet ray reflectance of the orthogonal surface portion of the cover member, which is substantially perpendicular to the recording surface, is made to be lower than that of the opposite surface portion of the cover member, which has the region opposed to at least the recording surface. That is, the incident angle of the ultraviolet ray reflected on the orthogonal surface portion to the recording surface is larger than the incident angle of the ultraviolet ray reflected on the opposite surface portion to the recording surface. Consequently, the ultraviolet ray reflected on the orthogonal surface portion is easier to pass through the space between the cover member and the recording surface in comparison with the ultraviolet ray reflected on the opposite surface portion, and the ultraviolet ray reflected on the orthogonal surface portion is easier to enter the nozzle surface, on which the jet opening of the recording head is located. According to the present invention, since the ultraviolet ray reflectance of the orthogonal surface portion is made to be lower than that of the opposite surface portion, the amount of the ultraviolet ray which has entered on the inner surface of the orthogonal surface portion and has been reflected on the inner surface of the orthogonal surface portion is decreased in comparison with that of the ultraviolet ray which has reflected on the opposite surface portion. Since the incidence amount of the ultraviolet ray reflected on the orthogonal surface portion to the recording surface can be decreased thereby, the amount of the ultraviolet ray which has been reflected on the recording surface and advances toward the recording head can be decreased. That is, the incidence amount of the ultraviolet ray radiated from the ultraviolet ray irradiation device to the nozzle surface can be decreased.

Consequently, it is possible to prevent the bodying and the curing of the ink on the nozzle surface and in the jet opening based on the reactions of the ultraviolet ray which has entered on the nozzle surface with the ink existing on the nozzle surface and in the jet opening thereof, and to make it difficult that an imperfect jetting of the nozzle occur. As a result, the stable jetting of ink can be performed over a long period of time.

On the other hand, since the incident angle of the ultraviolet ray reflected on the opposite surface portion to the recording surface is smaller than that of the ultraviolet ray reflected on the orthogonal surface portion, and then the ultraviolet ray reflected on the opposite surface portion is difficult to enter the recording head side. Consequently, the ultraviolet ray reflectance of the opposite surface portion can be made to be higher than that of the orthogonal surface portion. Thereby, the radiation amount of the ultraviolet ray to the ink on the recording medium can be secured to be a suitable amount.

Moreover, since the incident angle of the ultraviolet ray reflected on the orthogonal surface portion to the recording surface becomes larger than one of the ultraviolet ray reflected on the opposite surface portion, the ultraviolet ray reflected on the orthogonal surface portion reaches a position more distant from the ultraviolet ray irradiation device than the ultraviolet ray reflected on the opposite surface portion. But, since the amount of the ultraviolet ray reflected on the orthogonal surface portion can be decreased, it is possible to arrange the ultraviolet ray irradiation device and the recording head in close vicinity to each other, and it is possible to contribute to the miniaturization of the inkjet printer.

Here, the incident angle to the recording surface indicates an angle formed by the ultraviolet ray entering a line segment perpendicular to the recording surface and the line segment.

A reflection member to reflect the ultraviolet ray radiated from the ultraviolet ray light source toward the recording surface of the recording medium may be provided on the opposite surface portion.

According to the invention, since the reflection member reflecting the ultraviolet ray radiated from the ultraviolet ray light source toward the recording surface of the recording medium is provided on the opposite surface portion, the ultraviolet ray can be effectively reflected toward the recording surface by the reflection member. That is, by providing the reflection member on the opposite surface portion, the radiation amount of the ultraviolet ray from the ultraviolet ray irradiation device can be increased to be a predetermined amount necessary for ink curing. Furthermore, in this case, since the ultraviolet ray reflectance of the orthogonal surface portion is made to be lower than that of the opposite surface portion, the amount of the ultraviolet ray entering the nozzle surface is decreased even if the ultraviolet ray radiated from the ultraviolet ray light source is reflected on the orthogonal surface portion.

An ultraviolet ray absorbing member configured to include a material which absorbs the ultraviolet ray radiated from the ultraviolet ray light source may be provided on the orthogonal surface portion.

Here, the ultraviolet ray absorbing member indicates a member absorbing an ultraviolet ray at a predetermined rate, and the rate can be arbitrarily set within the limit of design.

Incidentally, the absorption of the ultraviolet ray is substantially the same meaning of decreasing the amount of the reflection of the ultraviolet ray. That is, as the absorption rate of the ultraviolet ray increases, the reflectance of the ultraviolet ray falls.

According to the invention, since the ultraviolet ray absorbing member configured to include the material absorbing the ultraviolet ray radiated from the ultraviolet ray light source is provided on the orthogonal surface portion, it is possible to absorb the ultraviolet ray entering the orthogonal surface portion to effectively decrease the amount of the ultraviolet ray reflected toward the recording surface. Consequently, it is possible to decrease the amount of the ultraviolet ray which enters the recording surface after being reflected on the orthogonal surface portion and then is reflected on the recording surface and thereby passes through the space between the cover member and the recording surface to enter the nozzle surface of the recording head.

Thereby, the ultraviolet ray absorbing member and the recording head can be arranged in closer vicinity to each other, and it is possible to contribute to the miniaturization of the inkjet printer.

A plurality of ultraviolet ray light sources may be provided.

According to the invention, although the amount of the ultraviolet rays which have been radiated from the ultraviolet ray light sources to enter the orthogonal surface portion also increases when the number of the ultraviolet ray light sources increases, since the ultraviolet ray reflectance of the orthogonal surface portion is made to be lower than that of the opposite surface portion, the amount of the ultraviolet rays entering the nozzle surface can be deceased effectively.

Preferably, the orthogonal surface portion is provided with an intermediate orthogonal surface portion arranged between regions in which the plurality of ultraviolet ray light sources are located.

Here, "between regions in which the plurality of ultraviolet ray light sources are located" indicates "between line segments passing through the centers of respective ultraviolet ray light sources along the directions substantially perpendicular to the recording surface".

According to the invention, the incident angle of an ultraviolet ray reflected on the orthogonal surface portion to the recording surface is prescribed by the reflection angle of the ultraviolet ray on the orthogonal surface portion, and the reflection angle is prescribed by the incident angle of the ultraviolet ray to the orthogonal surface portion. Here, the smaller the incident angle of the ultraviolet ray to the orthogonal surface portion is, namely the larger the incident angle of the ultraviolet ray to the recording surface is, the easier the ultraviolet ray reflected on the recording surface passes through the space between the recording surface and the cover member and enters the nozzle surface of the recording head. In case of providing the plurality of ultraviolet ray light sources, the farther an ultraviolet ray light source is located from the orthogonal surface portion along a direction substantially parallel to the recording surface, the smaller the incident angle of the ultraviolet ray radiated from the ultraviolet ray light source to the orthogonal surface portion is. However, according to the present invention, the intermediate orthogonal surface portion is arranged between the regions in which the plurality of ultraviolet ray light sources are located, and consequently the distances of the ultraviolet ray light sources to the intermediate orthogonal surface portion and the orthogonal surface portion are shortened. Thereby, the incident angles of the ultraviolet rays radiated from the ultraviolet ray light sources into the intermediate orthogonal surface portion and the orthogonal surface portion can be made to be large.

Consequently, since the incident angle of an ultraviolet ray reflected on the intermediate orthogonal surface portion and the orthogonal surface portion to the recording surface can be made to be small, the amount of the ultraviolet ray which passes through the space between the recording surface and the cover member can be decreased, and the incidence amount of the ultraviolet ray to the nozzle surface can be made to decrease similarly to the invention according to claim 11. Thereby, it is possible to arrange the ultraviolet ray irradiation device and the recording head to be in closer vicinity to each other, and also it is possible to miniaturize the inkjet printer.

Here, the incident angle to the orthogonal surface portion and the reflection angle on the orthogonal surface portion indicate the incident angle and the reflection angle of the ultraviolet ray to a line segment perpendicular to the orthogonal surface portion.

A light trap to trap the ultraviolet ray radiated from the ultraviolet ray irradiation device may be provided between the recording head and the ultraviolet ray irradiation device.

According to the invention, the incidence amount of the ultraviolet ray to the nozzle surface can be further decreased by trapping the ultraviolet ray which has been radiated by the ultraviolet ray irradiation device and is reflected on the recording surface to the recording head side with the light trap.

Preferably, the ultraviolet ray light source is any one of a high pressure mercury lamp, a metal halide lamp, a hot-cathode tube, a cold-cathode tube and an LED.

According to the invention, the ultraviolet ray light source is any one of the high pressure mercury lamp, the metal halide lamp, the hot-cathode tube, the cold-cathode tube and the LED. Even in this case, the incidence amount of the ultraviolet ray radiated from the ultraviolet ray irradiation device to the nozzle surface can be certainly decreased by lowering the ultraviolet ray reflectance of the orthogonal surface portion than that of the opposite surface portion.

Consequently, an effect equal to the one of the invention according to claim 11 can be obtained.

Preferably, the ink is a cation curing type ink.

According to the invention, the cation curing type ink has higher sensitivity to the ultraviolet ray in comparison with the radical curing type ink, and an acid belonging to an active species has a property of accumulating light energy. Consequently, the cation curing type ink is easily influenced by the ultraviolet ray on the nozzle surface of the recording head. But, even in such a cation curing type ink, by lowering the ultraviolet ray reflectance of the orthogonal surface portion than that of the opposite surface portion, the incidence amount of the ultraviolet ray radiated from the ultraviolet ray irradiation device to the nozzle surface can be certainly decreased. Consequently, it is possible to prevent that the cation curing type ink is bodied or cured on the nozzle surface and in its jet opening.

Preferably, a record system is a serial system or a line system.

Here, the serial system indicates a system in which image recording is performed based on the jetting of ink from the recording head to the recording medium the conveyance of which in the direction perpendicular to the scanning direction of the recording head is stopped while the recording head is made to reciprocate in the scanning direction. Moreover, the line system indicates a system which comprises the recording head covering the width direction (the direction perpendicular to the conveyance direction of the recording medium) of the recording medium and performs image recording based on the conveyance of the recording medium.

According to the invention, even if the recording system is the serial system or the line system, by lowering the ultraviolet ray reflectance of the orthogonal surface portion than that of the opposite surface portion, the incidence amount of the ultraviolet ray radiated from the ultraviolet ray irradiation device to the nozzle surface can be certainly decreased.

Consequently, an effect equal to that of the invention according to claim 11 can be obtained.

BEST MODE FOR CARRYING OUT THE INVENTION

Hereinafter, embodiments of the present invention will be described with reference to FIGS. 1-16.

First Embodiment

Figure 1:
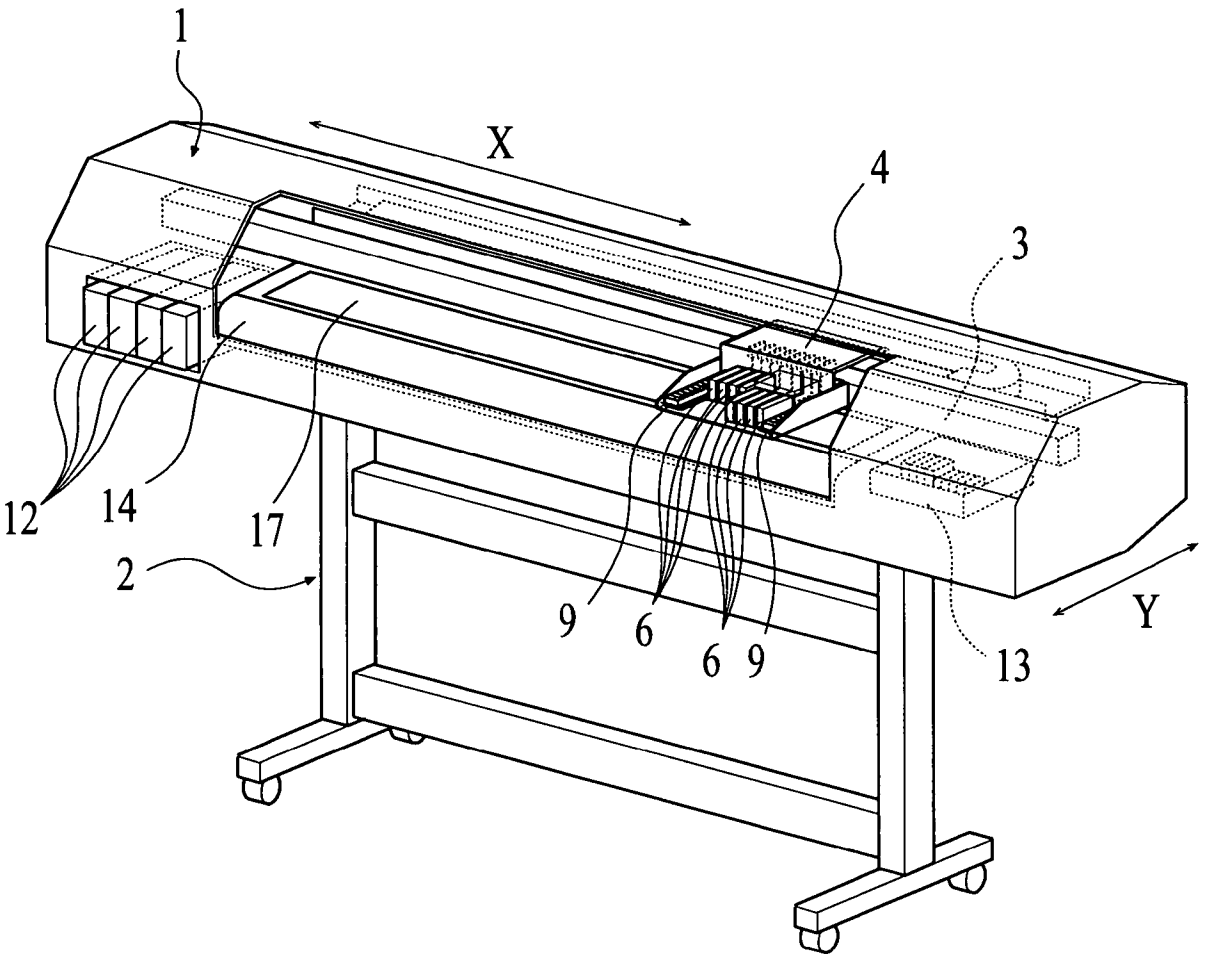
FIG. 1 is a view showing the configuration of a first embodiment of an inkjet printer by the present invention.

An inkjet printer by a first embodiment is an inkjet printer of a serial head system, and as shown in FIG. 1, the inkjet printer comprises a printer main body 1 and a supporting pedestal 2 supporting the printer main body 1. The printer main body 1 is provided with a rod-like guide rail 3, and a carriage 4 is supported by the guide rail 3. The carriage 4 is configured to perform reciprocating movement in a main scanning direction X along the guide rail 3 by a not shown drive mechanism.

Figure 2A:
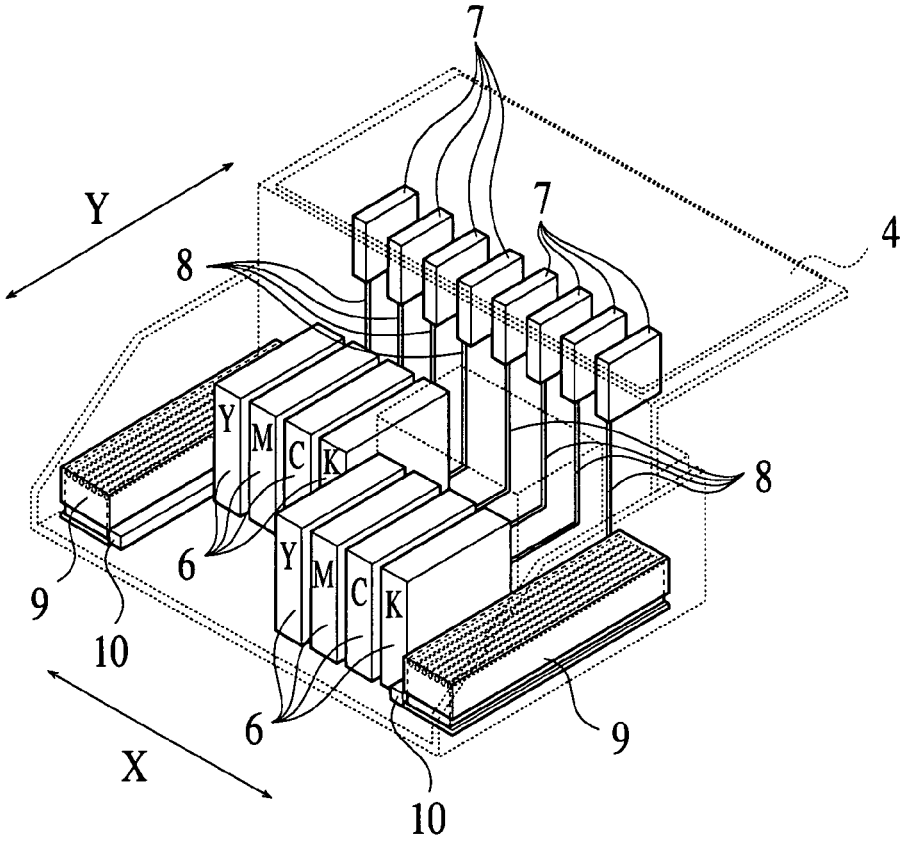
FIG. 2A is a perspective view of the inside of a carriage of the inkjet printer by the present invention.
Figure 2B:
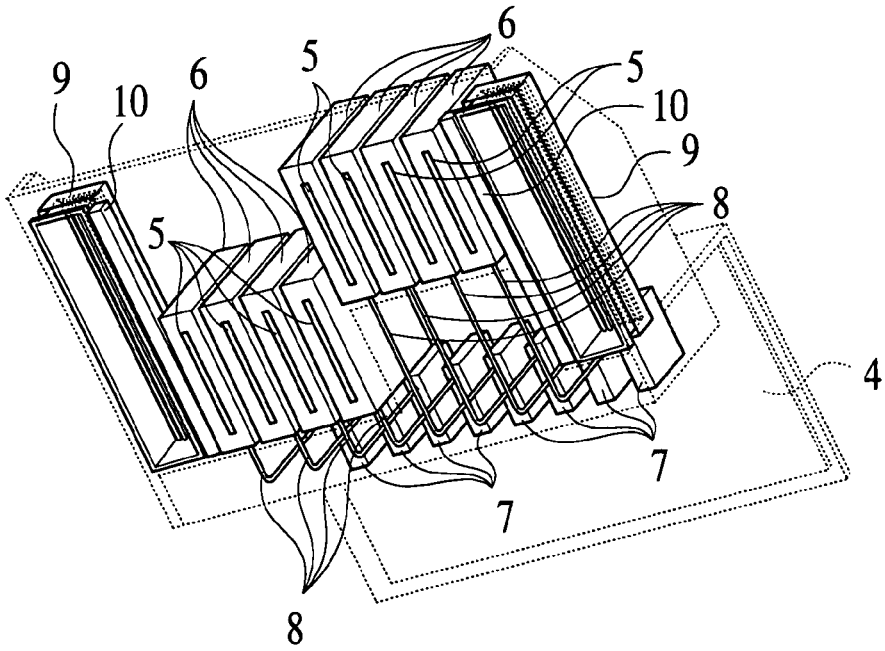
FIG. 2B is a perspective view in the case where the inside of the carriage of the inkjet printer by the present invention is viewed from the lower part.

As shown in FIGS. 2A and 2B, the carriage 4 is mounted with recording heads 6 each provided with a nozzle 5 jetting each of the color inks of yellow (Y), magenta (M), cyan (C) and black (K). Incidentally, in FIGS. 2A and 2B, the carriage 4 is shown with broken lines and the states of seeing through the carriage 4 are shown.

The recording heads 6 of respective colors of the yellow (Y), the magenta (M), the cyan (C) and the black (K) constitute a recording unit, and two recording units located side by side in the main scanning direction X are arranged in a state in which their positions are shifted in a sub-scanning direction Y perpendicular to the main scanning direction X. Intermediate tanks 7 storing respective colors therein communicate with the recording heads 6 through ink supplying pipes 8 severally. Moreover, on both side portions of the recording heads 6 in the main scanning direction in the carriage 4, ultraviolet ray irradiation devices 9 radiating ultraviolet rays to the ink jetted on a recording medium 17 from the nozzles 5 are provided. Moreover, in spaces between the ultraviolet ray irradiation devices 9 and the recording heads 6, light traps 10 trapping the ultraviolet rays entering the sides of the recording heads 6 are provided.

The light traps 10 are configured to be long members extending along the sub-scanning direction Y, and their lengths are at least equal to the lengths of the ultraviolet ray irradiation devices 9 along the sub-scanning direction Y. Moreover, the light traps 10 are concave members opened toward the side of the recording medium 17, and are located, for example, so that the edges of the openings may be substantially parallel with the recording medium 17.

Incidentally, the forms of the light traps 10 may be ones which enable the incidence of ultraviolet rays in the light traps 10 and the entered ultraviolet rays repeat reflections on the inner surface of the light traps 10.

Moreover, ultraviolet ray absorbing members (the illustration of which is omitted) made of a material having a high ultraviolet ray absorption rate may be provided on the inner surfaces of the light traps 10. In this case, the ultraviolet rays entering the inner surfaces of the light traps 10 can be certainly absorbed. Incidentally, the method of providing the ultraviolet ray absorbing members in the inner surfaces of the light traps 10 and the materials of the ultraviolet ray absorbing members may be, for example, the same as the method of providing an ultraviolet ray absorbing member 19 on the inner surface of a reflection member 18 and the material of the ultraviolet ray absorbing member 19, which will be described later.

As shown in FIG. 1, the central portion of the movable range of the carriage 4 is configured as a recording region in which recording on the recording medium 17 is performed. Ink supplying portions 12 supplying ink to the intermediate tanks 7 mounted in the carriage 4 through not shown ink supplying paths are provided at one end on the outside of the recording region which end is in the movable range of the carriage 4. Moreover, a maintenance unit 13 cleaning the recording heads 6 is provided on the other end of the recording region on the outside of the recording region which is in the movable range of the carriage 4.

Moreover, a conveyance mechanism (not shown) for sending the recording medium 17 in the sub-scanning direction Y is provided in the printer main body 1. The conveyance mechanism comprises, for example, a conveyance motor, a conveyance roller and the like, which are not shown, and the conveyance mechanism is configured so that the recording medium 17 may be conveyed in the sub-scanning direction Y by rotating the conveyance roller by the drive of the conveyance motor. Moreover, at the time of image recording, synchronously with the operation of the carriage 4, the conveyance mechanism repeats conveyance and a stop of the recording medium 17, and thereby conveys the recording medium 17 intermittently.

Moreover, a platen 14 supporting the recording medium 17 from the non-recording surface thereof is provided in the recording region in the lower part of the carriage 4. The platen 14 is made of a plate-like member.

Figure 3A:
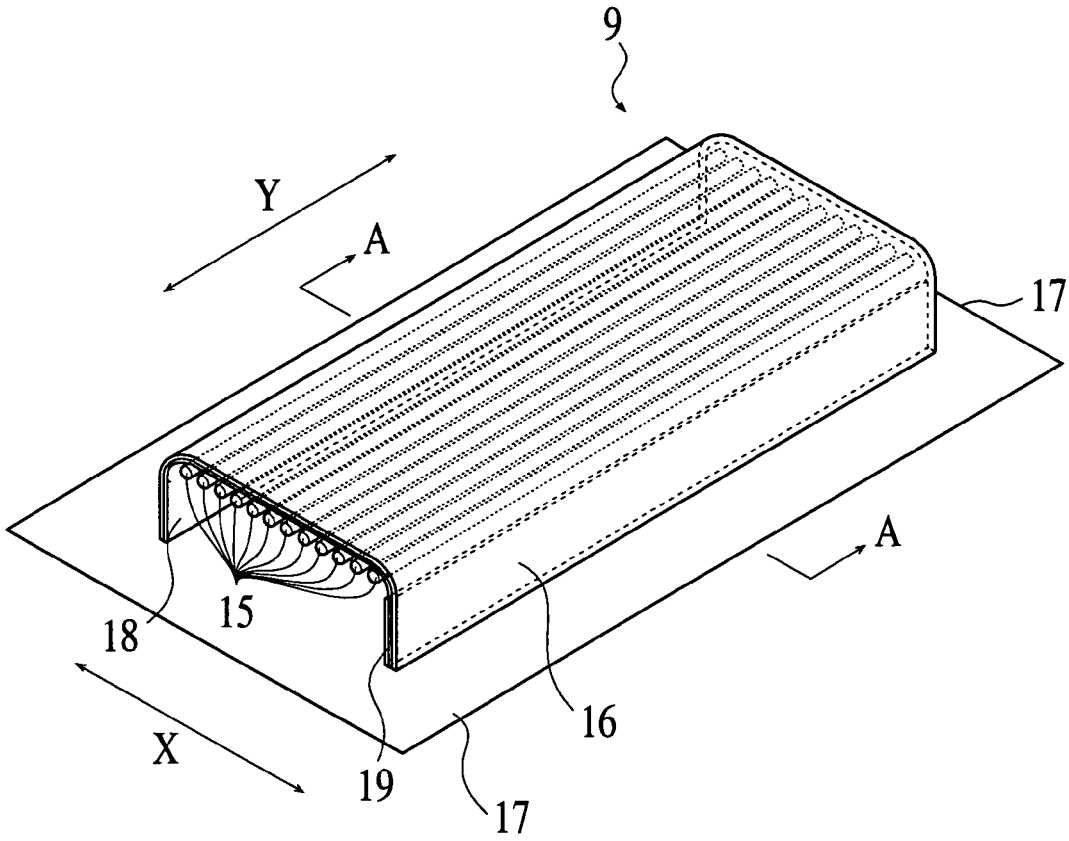
FIG. 3A is a perspective view showing an ultraviolet ray irradiation device of the inkjet printer by the present invention.
Figure 3B:
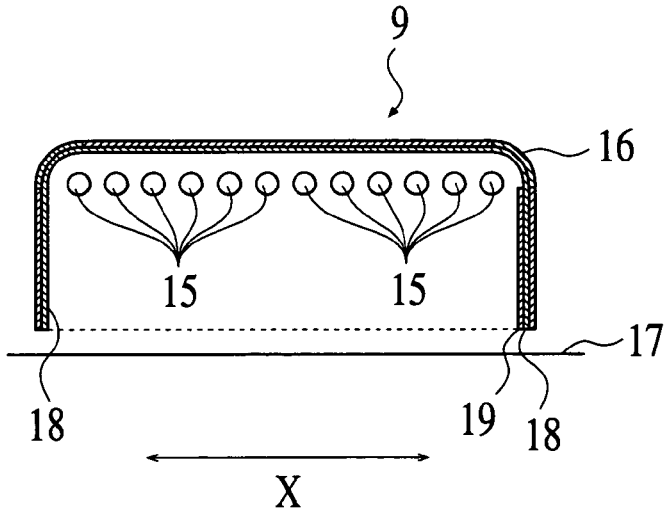
FIG. 3B is a sectional view take along an A-A line of FIG. 3A.

Next, the ultraviolet ray irradiation devices 9 will be described in detail with reference to FIGS. 3A and 3B.

The ultraviolet ray irradiation device 9 includes a boxy cover member 16 opened toward the side of the recording medium 17, and a plurality of linear ultraviolet ray light sources 15 along the sub-scanning direction Y are arranged in the main scanning direction X in the inner part of the cover member 16. The ultraviolet ray light sources 15 have lengths each equal to the length obtained by adding the lengths of the two recording units in the sub-scanning direction Y. As each of the ultraviolet ray light sources 15, at least one of a high pressure mercury lamp, a metal halide lamp, a hot-cathode tube, a cathode ray tube and LED.

The reflection member 18 reflecting the ultraviolet rays radiated from the ultraviolet ray light sources 15 to be spread is provided in the entire area on the inner surface of the cover member 16. As the reflection member 18, for example, a reflecting plate made of high-purity aluminum which efficiently reflects ultraviolet rays over the entire wavelength range is applied. In particular, a cold mirror (molded glass plate) made by evaporating a thin film of a metal compound including aluminum mainly on the surface of glass is preferable because the cold mirror effectively reflects ultraviolet rays, and on the other hand, the cold mirror makes visible rays and infrared rays, which do not contribute to the curing of ink, penetrate the mirror into the back thereof to enable the restraining of the lowering of the luminous efficiency owing to the generation of heat of the light sources.

Moreover, the ultraviolet ray absorbing member 19 is provided on the inner surface of an isolated perpendicular surface, which is a surface of the cover member 16 perpendicular to the recording medium 17 and is distant from the recording heads 6, so as to cover the reflection member 18. On the other hand, the ultraviolet ray absorbing member 19 is not provided on the inner surface of the adjacent perpendicular surface, which is a surface of the cover member 16 perpendicular to the recording medium 17 and adjacent to the recording heads 6, and the adjacent perpendicular surface is in the state in which the reflection member 18 is exposed. Consequently, the isolated perpendicular surface has a reflection rate lower than one of the adjacent perpendicular surface.

As a method of providing the ultraviolet ray absorbing member 19, for example, a method of performing the plating processing, the vapor deposition processing or the sputtering processing of a material having a high ultraviolet absorption rate, a method of coating a material having a high ultraviolet absorption rate, and the like can be cited.

Incidentally, as the material having the high ultraviolet absorption rate, for example, an inorganic substance such as powder of carbon black, titanium oxide in the state of super particles, zinc oxide, and iron oxide ($\alpha$-$Fe_2O_3$, $Fe_3O_4$), an organic substance such as benzotriazole series compound and aromatic compounds, and the like can be cited. The ultraviolet ray absorbing member 19 is constituted by such materials.

Here, the ink used for the present embodiment is described.

As the ink used for the present embodiment, in particular, the ink suiting with "Curing System Utilizing Photo-Acid and Base Generating Agent (Section 1)", or "Photo-induced Alternating Copolymerization (Section 2)" of "Photo-Curing System (Chapter 4)" in "Photo-Curing Technique—Selection and Compounding Condition of Resin and Initiator, and Measurement and Assessment of Curing Degree (Technical Association Information)" can be applied, and the ink may be one being cured by normal radical polymerization.

To put it concretely, the ink used for the present embodiment is a photo-curing type ink which possesses a property of being cured by being irradiated with an ultraviolet ray as light and contains a polymerizable compound (including a publicly known polymerizable compound), a photoinitiator, and a color material at least as the principal components. However, when the ink which suits with the above "photo-induction type alternating copolymerization (Paragraph 2)" is used as the ink used for the present embodiment, the photoinitiator may be excluded.

The photo-curing type ink is roughly divided into the radical polymerization series ink containing a radically polymerizable compound, and the cationic polymerization series ink containing a cationically polymerizable compound as a polymerizable compound. Both series of the inks can be severally applied as the ink to be used in the present embodiment. A hybrid type ink made by compounding the radical polymerization series ink and the cationic polymerization series ink may be applied as the ink to be used in the present embodiment.

However, since the cationic polymerization series ink, which has less or no inhibitory activity of polymerization reactions by oxygen, is superior in functionality and in versatility, the cationic polymerization series ink is especially used in the present embodiment.

Incidentally, the cationic polymerization series ink used for the present embodiment is a mixture which specifically contains cationically polymerizable compounds such as an oxetane compound, an epoxy compound and a vinyl ether compound, a photo cation initiator and a color material at least, and, naturally possesses the property of curing by being irradiated by an ultraviolet ray.

Now, although the ink (including the radical polymerization series ink, the cationic polymerization series ink and the hybrid type ink) used for the present embodiment is cured by the irradiation of an ultraviolet ray as described above, the ink is not necessarily limited to this type one, but may be one to be cured by the irradiation of light other than the ultraviolet ray. The "light" here is the light of a broad sense, and includes electromagnetic waves such as an ultraviolet ray, an electronic beam, an X-ray, visible light, infrared rays and the like. That is, the polymerizable compound to be polymerized to be cured by light other than the ultraviolet ray, and the photoinitiator initiating a polymerization reaction between polymerizable compounds with the light other than the ultraviolet ray may be applied as the ink of the present embodiment. When the photo-curing type ink cured by the light other than the ultraviolet ray is used, light sources radiating the light should be applied in place of the ultraviolet ray light sources 15.

Next, the recording medium 17 used for the present embodiment is described.

As the recording medium 17 used for the present embodiment, the recording medium 17 to be applied to a normal inkjet printer, which is made of the quality of the materials such as various kinds of paper such as plain paper, recycled paper and glossy paper, various kinds of cloth, various nonwoven fabrics, resins, metals and glass, can be applied. As the form of the recording medium 17, the shapes of a roll, a cut sheet, a plate and the like are applicable. In the present embodiment, a long film made of a resin and rolled in the shape of a roll is used as the recording medium 17.

In particular, as the recording medium 17 used for the present embodiment, a transparent or opaque nonabsorbable film made of a resin, which is used for the so-called flexible packaging, is applicable. As the kinds of concrete resins of the films made of the resins, polyethylene terephthalate, polyester, polyolefin, polyamide, polyester amide, polyether, polyimide, polyamide imide, polystyrene, polycarbonate, poly-ρ-phenylene sulfide, polyether ester, polyvinyl chloride poly (meta) acrylic ester, polyethylene, polypropylene, nylon and the like can be applied. Moreover, the copolymers of the resins, the mixtures of the resins, materials made by crosslinking the resins also applicable. It is preferable to select any of the drawn polyethylene terephthalate, the polystyrene, the polypropylene and the nylon as the kind of the resin of the film made of the resin among them in terms of the transparency, the dimensional stability, the stiffness, the environmental burden, the cost and the like of the film made of the resin, and it is preferable to use the film made of the resin which has the thickness of 2-100 μm (preferably 6-50 μm). Moreover, surface treatment such as corona discharge treatment and adhesion pretreated may be performed to the surface of the backing of the film made of the resin.

Furthermore, the opaque publicly known recording media 17 such as various kinds of paper the surface of which is covered with a resin, a film containing a pigment, and a foamed thin sheet are also applicable as the recording medium 17 used for the present embodiment.

Next, the operation of the first embodiment is described.

When an image is formed on the recording medium 17, the drive mechanism of the carriage 4 operates and the carriage 4 performs reciprocating movement in the main scanning direction X above the recording medium 17, and the ink of a predetermined color is jetted from a nozzle 5 of a recording head 6 based on predetermined image information. The jetted ink sequentially lands on the recording medium 17. Ultraviolet rays are sequentially radiated to the ink which has landed on the recording medium 17 by the ultraviolet ray light sources 15 constituting the ultraviolet ray irradiation devices 9 provided in the carriage 4, and the ink is cured on the recording medium 17. Meanwhile, the conveyance mechanism operates to convey the recording medium 17 in the sub-scanning direction Y, and thereby an image is recorded on the recording medium 17. Incidentally, when the ink adheres on the nozzle surface, or the like, the recording heads 6 are suitably cleaned by the maintenance unit 13.

Figure 4:
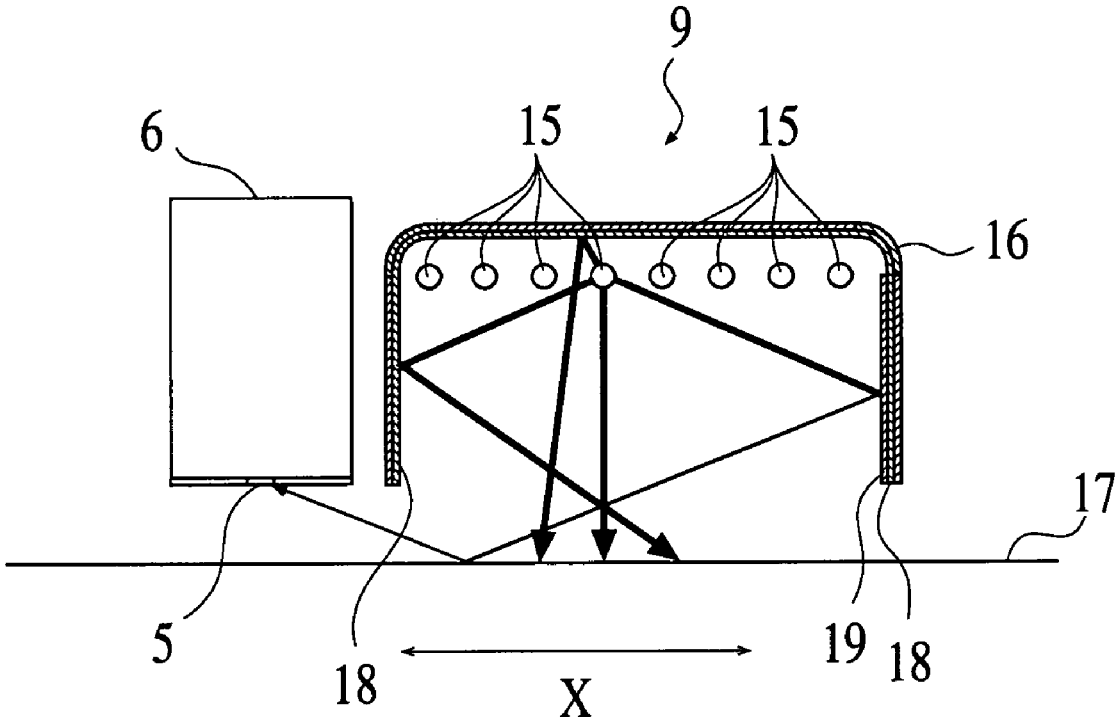
FIG. 4 is an explanatory view schematically showing the reflection of ultraviolet rays in the ultraviolet ray irradiation device of the inkjet printer by the present invention.

Here, with reference to FIG. 4, the reflection operation and the absorption operation of ultraviolet rays radiated from an ultraviolet ray light source 15 on the inner surface of an ultraviolet ray irradiation device 9 and on the surface of the recording medium 17 are described.

As shown in FIG. 4, among the ultraviolet rays radiated from the ultraviolet ray light source 15, the ultraviolet ray radiated to the ultraviolet ray absorbing member 19 is absorbed by the ultraviolet ray absorbing member 19 to become an ultraviolet ray having low energy, and is reflected to be radiated to the surface of the recording medium 17. After that, the ultraviolet ray having the decreased energy is absorbed and reflected on the surface of the recording medium 17, and becomes an ultraviolet ray having still lower energy to be radiated to the nozzle surface of the recording head 6. On the other hand, among the ultraviolet rays radiated from the ultraviolet ray light source 15, ultraviolet rays radiated to the reflection member 18 are reflected by the reflection member 18 at the ultraviolet ray reflectance of the reflection member 18, and are radiated to the surface of the recording member 17 with high energy. After that, although the ultraviolet rays having the high energy are absorbed and reflected on the surface of the recording medium 17, since the ultraviolet rays are reflected in the opposite direction to a recording head 6 or to the inside of the cover member 16 at this time, the ultraviolet ray does not reach the nozzle surface of the recording head 6.

Incidentally, an ultraviolet ray which has been launched perpendicularly to the recording medium 17 is radiated to the surface of the recording medium 17 with the energy at the time of being launched. The ultraviolet ray of the high energy does not reach the nozzle surface of the recording head 6 as it is, either.

Moreover, a part of the low energy ultraviolet ray which is reflected on the isolated perpendicular surface of the cover member 16 and the surface of the recording medium 17 to be launched to the nozzle surface is trapped by a light trap 10 provided between the ultraviolet ray irradiation device 9 and the recording head 6. Consequently, the amount of the ultraviolet ray which reaches the recording head 6 is further decreased.

As mentioned above, according to the first embodiment, the ultraviolet ray which enters the recording head 6 by reflection becomes the ultraviolet ray of low energy to reach the nozzle surface of the recording medium 17. On the other hand, the ultraviolet rays which do not enter the recording head 6 even if they are reflected are radiated by the surface of the recording medium 17 with high energy. Consequently, it is possible to decrease the amount of the ultraviolet ray reaching the nozzle surface by reflection while securing the necessary and sufficient amount of the ultraviolet ray for curing ink which has landed on the recording medium 17, and the bodying and the curing of the ink can be prevented to enable a stable jetting of the ink.

Moreover, since the amount of the ultraviolet ray which reaches the nozzle surface by reflection can be decreased, the ultraviolet ray irradiation device 9 and the recording head 6 can be arranged in close vicinity to each other, and it is possible to miniaturize the inkjet printer.

Incidentally, although the two recording units each comprising the recording heads 6 of the respective colors of yellow (Y), magenta (M), cyan (C) and black (K) are provided and one ultraviolet ray irradiation device 9 is provided to each of the recording units in the present embodiment, the numbers of the components are not limited to those. As long as the ultraviolet ray irradiation device 9 is provided at least on one of the both side portions of the recording heads 6 in the main scanning direction X, the numbers and the locating positions of the recording heads 6 and the ultraviolet ray irradiation devices 9 are arbitrary.

Moreover, in the first embodiment, the reflection member 18 reflecting ultraviolet rays is provided all over the inner surface of the cover member 16, and furthermore the ultraviolet ray absorbing member 19 is provided on the inner surface of the isolated perpendicular surface so as to cover the reflection member 18. However, as long as the ultraviolet ray reflectance of the isolated perpendicular surface is lower than the ultraviolet ray reflectance of the other surfaces, the configuration is not limited to the one of the first embodiment.

For example, the cover member may be made of a reflective material without providing the reflection member 18, and the ultraviolet ray absorbing member 19 may be provided on the isolated perpendicular surface. The cover member 16 may be made of an ultraviolet absorbing material without providing the ultraviolet ray absorbing member, and a reflection member may be provided on the surfaces other than the isolated perpendicular surface.

Figure 5A:
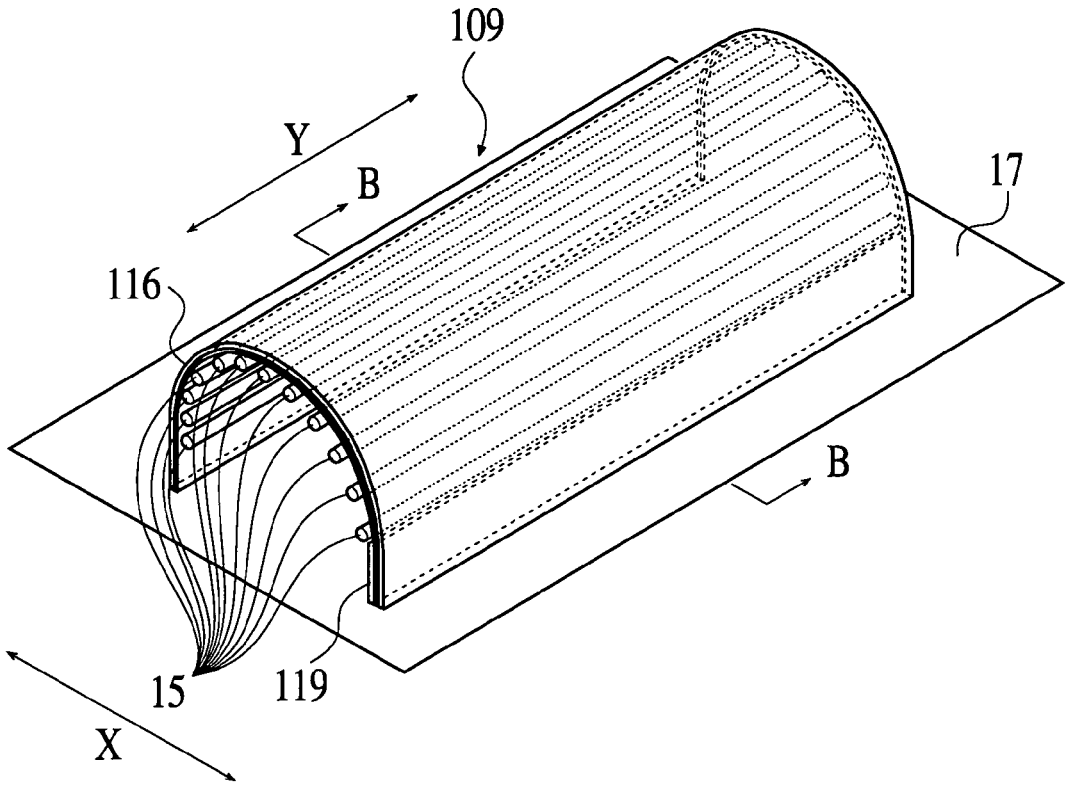
FIG. 5A is a perspective view of the ultraviolet ray irradiation device of the inkjet printer by the present invention.
Figure 5B:
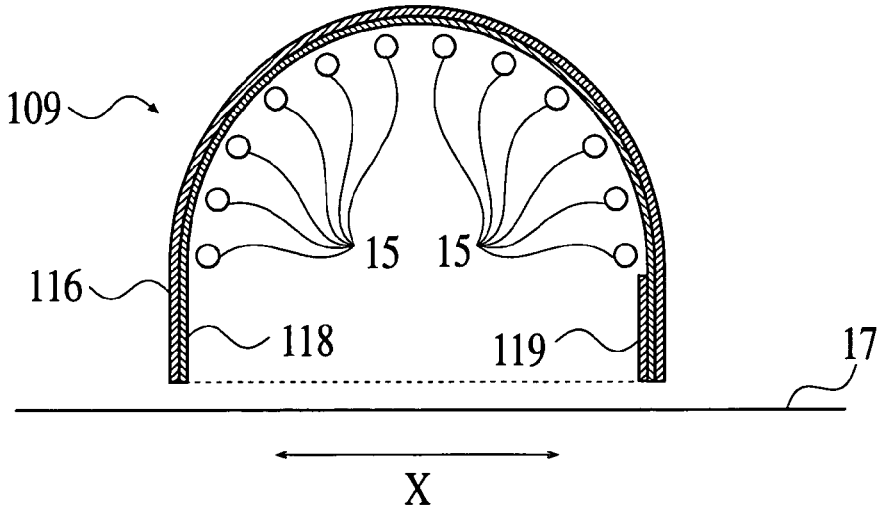
FIG. 5B is a sectional view taken along a line B-B of FIG. 5A.
Figure 6A:
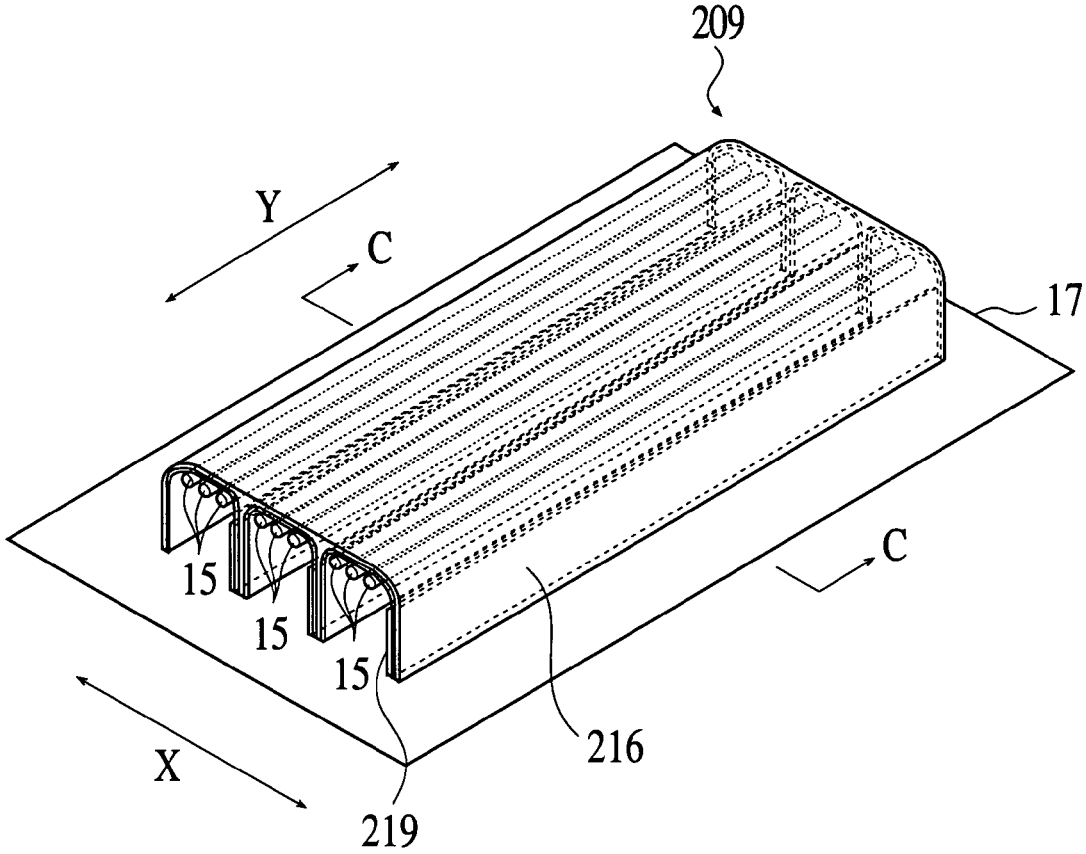
FIG. 6A is a perspective view of an ultraviolet ray irradiation device of an inkjet printer by a second embodiment.
Figure 6B:
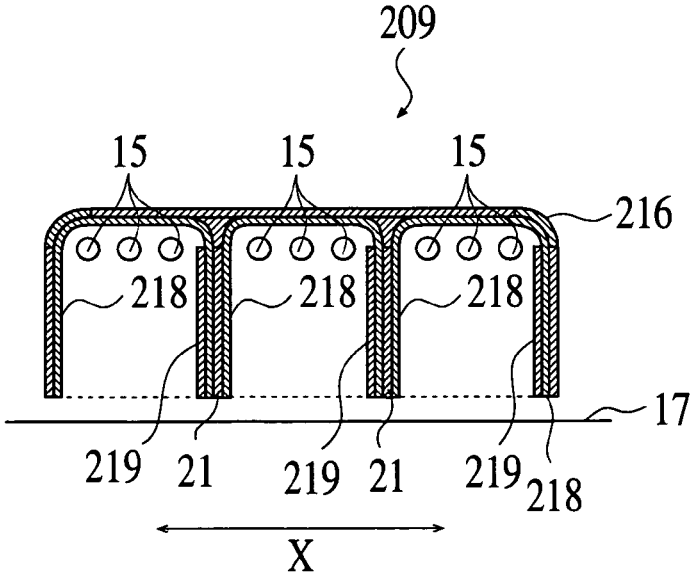
FIG. 6B is a sectional view taken along a line C-C of FIG. 6A.

Moreover, although the cover member 16 is formed as a boxy form opened toward the side of the recording member 17 in the first embodiment, the form of the cover member 16 is not limited to that form. As shown in FIGS. 5A and 5B, the form of the cover member 16 may be arch-like one opened toward the side of the recording medium 17. Incidentally, also in this case, a reflection member 118 may be provided on all areas of the inner surface of a cover member 116, and furthermore an ultraviolet ray absorbing member 119 may be provided on the surface of the covering member 116 which is perpendicular to the recording medium 17 and is distant from the recording head 6 so as to cover the reflection member 118. By forming the cover member 116 to be an arch shape, the width of an ultraviolet ray irradiation device 109 in the main scanning direction X can be reduced without decreasing the number of the ultraviolet ray light sources 15 in comparison with the width of the boxy cover member 16. Consequently, the carriage 4 can be miniaturized, and furthermore the whole inkjet printer can be miniaturized.

Second Embodiment

Next, a second embodiment of the inkjet printer according to the present invention is described with reference to FIGS. 6A to 7B. Incidentally, since the inkjet printer according to the second embodiment has the same configuration as one of the inkjet printer according to the first embodiment except for an ultraviolet ray irradiation device 209, the ultraviolet ray irradiation device 209 is chiefly described. Moreover, since the components denoted by the same reference marks as those of the first embodiment are ones similar to those of the first embodiment, their descriptions are omitted.

The ultraviolet ray irradiation device 209 includes a boxy cover member 216 opened toward the side of the recording medium 17. The plurality of linear ultraviolet ray light sources 15 along the sub-scanning direction Y are arranged in the inside of the cover member 216 in the main scanning direction X.

In this cover member 216, laminar partition members 21 partitioning the inside of the cover member 216 into three sections are provided perpendicularly to the recording medium 17.

Reflection members 218 reflecting ultraviolet rays radiated from the ultraviolet ray light sources 15 to spread are provided on the inner surface of the cover member 216 and on the surfaces of the partition members 21.

Moreover, ultraviolet ray absorbing members 219 are provided on the inner surface of the isolated perpendicular surface of the cover member 216 and on the surfaces of the partition members 21 which are perpendicular to the recording medium 17 and are located on the side of the recording head 6 so as to cover the reflection members 218.

On the other hand, no ultraviolet ray absorbing members are provided on the inner surface of the adjacent perpendicular surface of the cover member 216 and on the surfaces of the partition members 21 which are perpendicular to the recording medium 17 and are located to be distant from the recording head 6, and those surfaces are in the state in which the reflection members 218 are exposed.

Consequently, the ultraviolet ray reflectance of the surfaces on the inside of the cover member 216 which surfaces reflect ultraviolet rays radiated from the ultraviolet ray light sources 15 to the recording head 6 is lower than the ultraviolet ray reflectance of the other surfaces.

Next, the reflection operation and the absorbing operation of the ultraviolet rays radiated from the ultraviolet ray light sources 15 on the inside of the ultraviolet ray irradiation device 209 and the surface of the recording medium 17 are described with reference to FIGS. 7A and 7B.

Figure 7A:
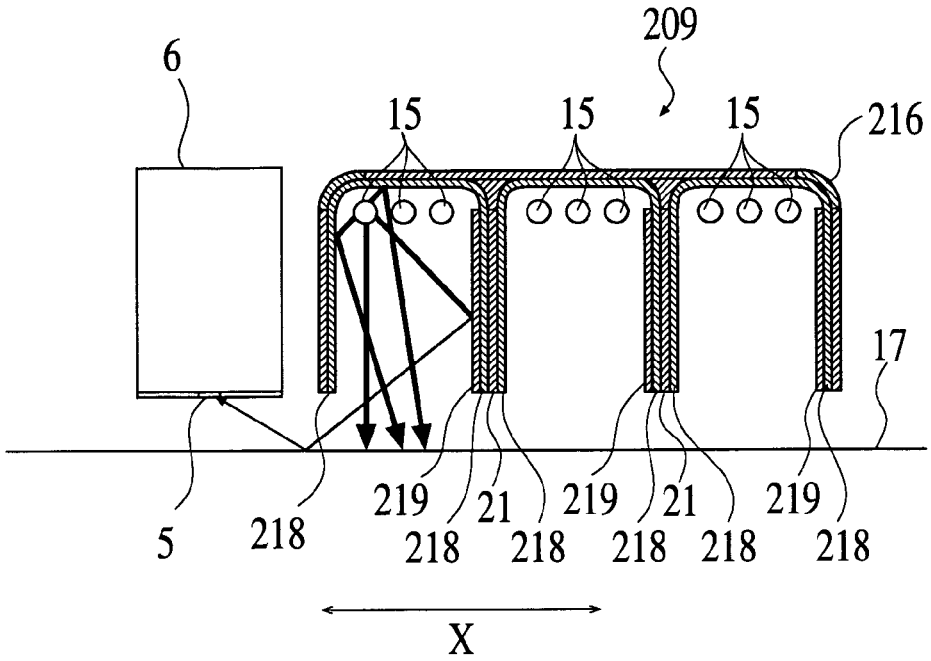
FIG. 7A and FIG. 7B are explanatory views schematically showing the reflection of ultraviolet rays in the ultraviolet ray irradiation device of the inkjet printer by the second embodiment.

As shown in FIG. 7A, an ultraviolet ray launched to the ultraviolet ray absorbing member 219 provided on the surfaces of the partition member 21 among the ultraviolet rays radiated from an ultraviolet ray light source 15 is absorbed by the ultraviolet ray absorbing member 219, and becomes an ultraviolet ray of reduced energy. Then, the ultraviolet ray of the reduced energy is reflected by the reflection member 218 provided under the ultraviolet ray absorbing member 219, and is radiated to the surface of the recording medium 17. After that, the ultraviolet ray of the reduced energy is absorbed and reflected on the surface of the recording medium 17 to become an ultraviolet ray of further lower energy, and is launched to the nozzle surface of the recording head 6. On the other hand, ultraviolet rays launched to the reflection member 218 provided on the cover member 216 among the ultraviolet rays radiated from the ultraviolet ray light source 15 are reflected at the ultraviolet ray reflectance of the reflection member 218, and are radiated to the surface of the recording medium 17 in the state of having high energy. After that, although the ultraviolet rays of the high energy are absorbed and reflected on the surface of the recording medium 17, since the ultraviolet rays are reflected in the opposite directions to the recording head 6 at this time, the ultraviolet rays do not reach the nozzle surface of the recording head 6.

Incidentally, an ultraviolet ray launched perpendicularly to the recording medium 17 is radiated to the surface of the recording medium 17 with the energy at the time of being launched. The ultraviolet ray of the high energy also does not reach the nozzle surface of the recording head 6 as it is, either.

Figure 7B:
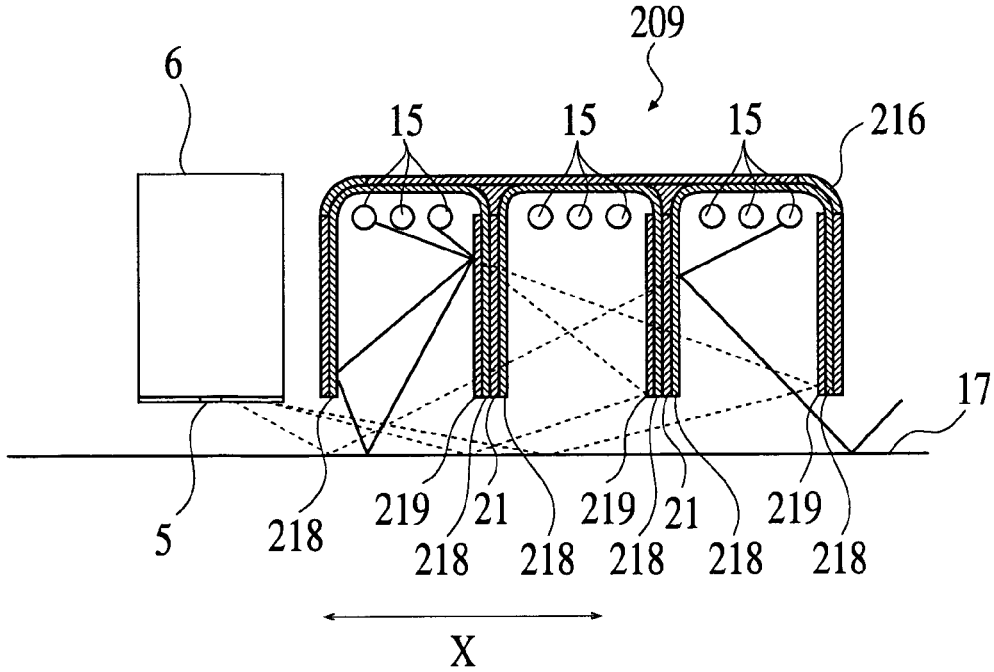
Figure 8A:
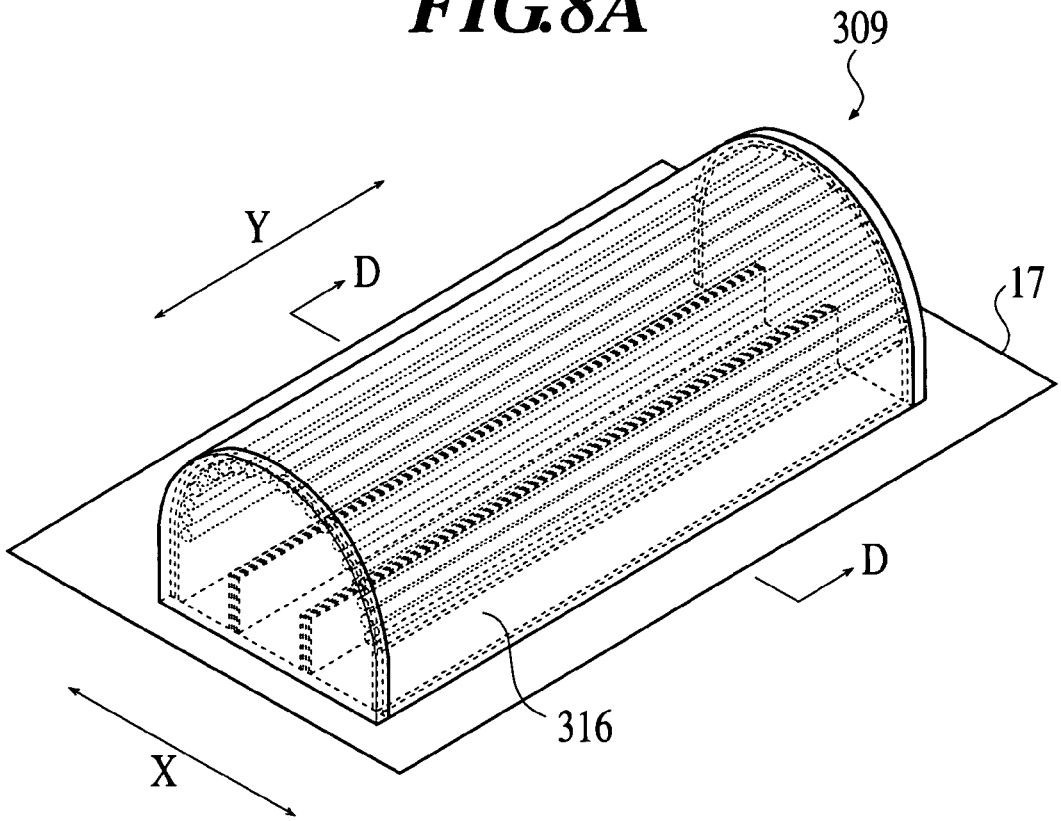
FIG. 8A is a perspective view showing an ultraviolet ray irradiation device of the inkjet printer by the second embodiment.
Figure 8B:
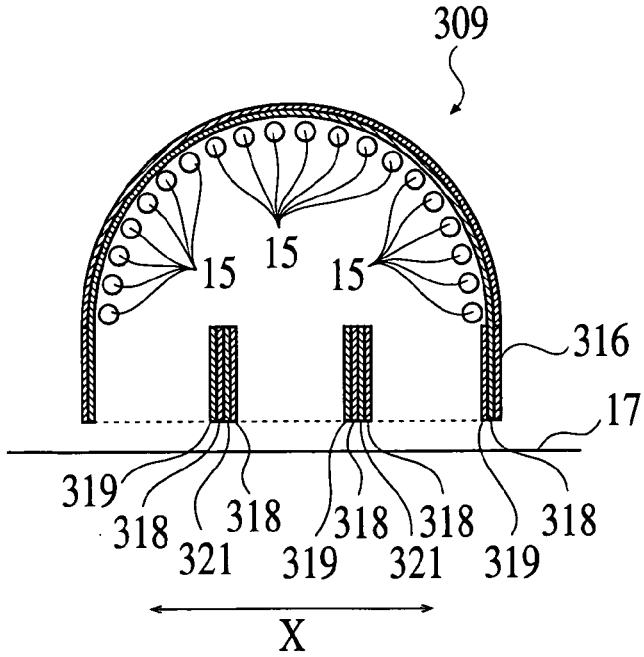
FIG. 8B is a sectional view taken along a line D-D of FIG. 8A.

Moreover, as shown in FIG. 7B, even if ultraviolet rays are ones (denoted by dotted lines schematically in FIG. 7B) which would be reflected in the cover member 216 to reach the recording head 6 if there were no partition members 21, a part of them is radiated toward the inside of the cover member 216 since it has a small incident angle to the surface of the recording medium and also has a small reflection angle. Moreover, another part of them is reflected by the partition members 21, and is radiated toward the inside of the cover member 216 directly. Consequently, the amount of the ultraviolet rays which reach the recording head 6 is reduced as a whole. Furthermore, since a part of the ultraviolet rays which would be reflected on the surface of the recording medium 17 to reach the recording head 6 if there were not the partition members 21 is reflected by the partition members 21, and is radiated toward the opposite direction to the recording head 6, the amount of the ultraviolet rays which reach the recording head 6 is remarkably reduced.

As mentioned above, according to the second embodiment, the ultraviolet rays entering the recording head 6 by reflection become ones having reduced energy, and reach the nozzle surface of the recording head 6. On the other hand, the ultraviolet rays which do not enter the recording head 6 even if they are radiated to the surface of the recording medium 17 with high energy. Consequently, while securing the necessary and sufficient amount of the ultraviolet rays to cure the ink which has landed on the recording medium 17, the amount of the ultraviolet rays reaching the nozzle surface by reflection can be decreased, and consequently the bodying and the curing of ink can be prevented to enable a stable jetting of the ink.

Moreover, since the amount of the ultraviolet rays which arrive at the nozzle surface by reflection can be reduced, the ultraviolet ray irradiation device 209 and the recording head 6 can be arranged to be in close vicinity to each other, and it is possible to miniaturize the inkjet printer.

Moreover, since a part of the ultraviolet rays which would reach the recording head 6 if there were not the partition members 21 can be reflected toward the inner side of the cover member 216 or in the opposite direction to the recording head 6 by the partition members 21, the amount of the ultraviolet rays which reach the recording head 6 can be reduced further. Consequently, while efficiently securing the necessary and sufficient amount of the ultraviolet rays to cure the ink which has landed on the recording medium 17, the bodying and the curing of the ink by reflection can be prevented, and it is possible to jet the ink stably.

Moreover, although the ultraviolet ray absorbing members 219 are provided on all of the perpendicular surfaces of the partition members 21 on the side of the recording head and the isolated perpendicular surface of the cover member 216 in the second embodiment, no ultraviolet ray absorbing members may be provided on the perpendicular surfaces of the partition members 21 distant from the recording head 6 on the side of the recording head 6 and the inner surface of the isolated perpendicular surface of the cover member 216 when the incident angles to the recording medium 17 of the ultraviolet rays reflected on those surfaces are sufficiently small and consequently no ultraviolet rays reach the recording head 6 even if they are reflected on the surface of the recording medium 17 owing to the wavelengths of the ultraviolet rays, the qualities of the materials of the reflection members 218, and the like.

Furthermore, although the cover member 216 is made to be a boxy form opened toward the side of the recording medium 17 in the second embodiment, the form of the cover member 216 is not limited to such one. As an ultraviolet ray irradiation device 309 shown in FIGS. 8A and 8B, the form of the cover member may be made to be an arch-like form opened to the side of the recording medium 17. In this case, partition members 321 preferably have heights almost equal to the portions of a cover member 316 perpendicular to the recording medium 17 from the point of view of the efficient reflection of ultraviolet rays. Incidentally, also in this case it may be preferable to provide reflection members 318 on the inner surface of the cover member 316 and on the surfaces of the partition members 321, and to provide ultraviolet ray absorbing members 319 on the inner surface of the isolated perpendicular surface of the cover member 316, and on the surfaces of the partition members 321 on the side of the recording head 6 so as to cover the reflection members 318.

Third Embodiment

Figure 9A:
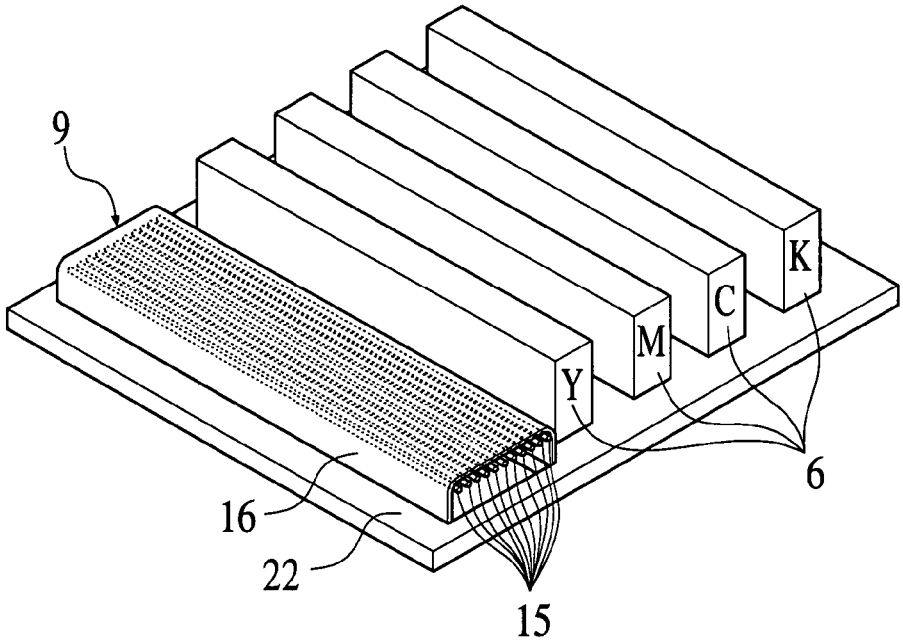
FIG. 9A is a perspective view showing a supporting pedestal of an inkjet printer by a third embodiment.
Figure 9B:
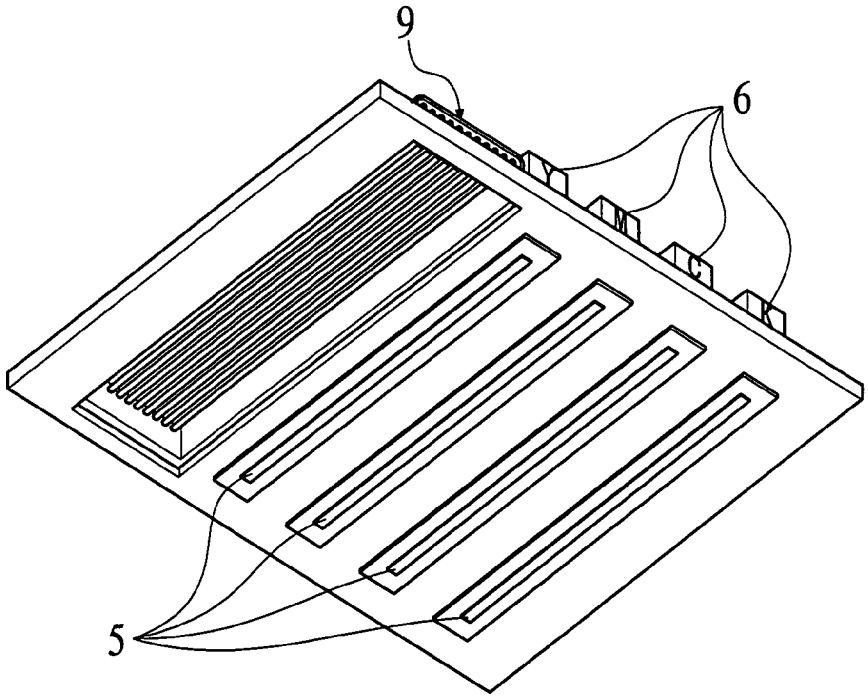
FIG. 9B is a perspective view showing the supporting pedestal of the inkjet printer by the third embodiment when it is viewed from the lower part.
Figure 10:
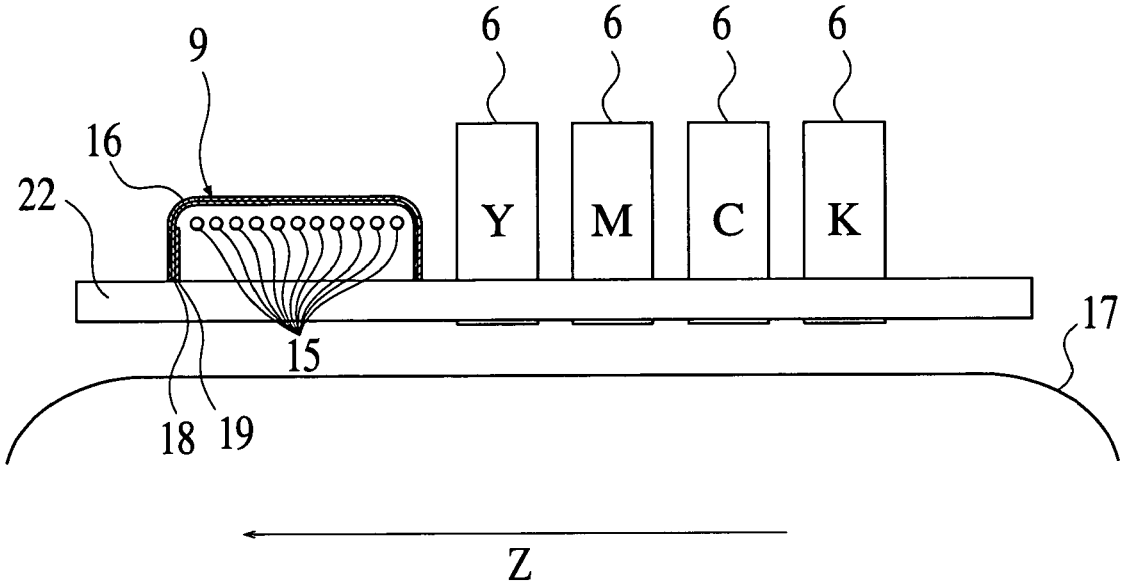
FIG. 10 is a front view showing the supporting pedestal of the inkjet printer by the third embodiment.

Next, a third embodiment of the inkjet printer by the present invention is described with reference to FIGS. 9A, 9B and 10. Incidentally, the components denoted by the same reference marks as those in the first embodiment are the same ones as those in the first embodiment, and consequently their descriptions are omitted.

The inkjet printer by the third embodiment is an inkjet printer of a line head system. At a predetermined position in the printer main body (not shown), a plate-like supporting member 22 is fixed, and the recording heads 6 in which the nozzles 5 to jet the respective colors of yellow (Y), magenta (M), cyan (C) and black (K) are formed are mounted on the supporting member 22 as shown in FIGS. 9A, 9B and 10. These recording heads 6 have the lengths covering almost the full width of the recording medium 17, and are provided so as to be perpendicular to a conveyance direction Z of the recording medium 17.

On the downstream side of the recording heads 6 in the direction Z along which the recording medium is conveyed, the ultraviolet ray irradiation device 9 which radiates ultraviolet rays to the ink jetted from the nozzles 5 to the recording medium 17 is provided. The ultraviolet ray irradiation device 9 includes the ultraviolet ray light sources 15 and the cover member 16 which covers the ultraviolet ray light sources 15. The reflection member 18 which reflects ultraviolet rays are provided on the entire area of the inner surface of the cover member 16 is formed, and furthermore the ultraviolet ray absorbing member 19 is provided on the inner surface of the isolated perpendicular surface of the cover member 16. Since the ultraviolet ray irradiation device 9 has the same configuration as the ultraviolet ray irradiation device 9 in the first embodiment, the detailed descriptions thereof are omitted.

A platen (not shown) which is composed of a plate-like member and supports the recording medium 17 on the non-recording surface thereof is provided below the supporting member 22. Moreover, in the printer main body, a conveyance mechanism (not shown) which conveys the recording medium 17 to the platen and conveys the recording medium 17 on which an image has been formed on the platen out of the platen is provided.

Next, the operation of the third embodiment is described.

The conveyance mechanism operates to convey the recording medium 17, and an ink of a predetermined color is jetted from a nozzle 5 of a recording head 6 mounted on the supporting member 22 based on predetermined image information. The jetted ink sequentially lands on the recording medium 17. Ultraviolet rays are sequentially radiated from the ultraviolet ray light sources 15 constituting the ultraviolet ray irradiation device 9 provided on the supporting member 22 to the ink which has landed on the recording medium 17, and the ink is cured on the recording medium 17. Meanwhile, an image is formed on the recording medium 17 by the conveyance of the recording medium 17 by the conveyance mechanism.

At this time, the ultraviolet rays launched to the ultraviolet ray absorbing member 19 among the ultraviolet rays radiated from the ultraviolet ray light sources 15 are absorbed by the ultraviolet ray absorbing member 19, and become ultraviolet rays of reduced energy. Then, the ultraviolet rays of the reduced energy is reflected by the reflection member 18 provided below the ultraviolet ray absorbing member 19, and are radiated to the surface of the recording medium. After that, the ultraviolet rays of the reduced energy are absorbed and reflected on the surface of the recording medium 17, and become ultraviolet rays of further low energy to be launched to the nozzle surface of the recording head 6. On the other hand, the ultraviolet rays launched to the reflection member among the ultraviolet rays radiated from the ultraviolet ray light sources 15 are reflected at the ultraviolet ray reflectance of the reflection member 18, and are radiated to the surface of the recording medium 17 with high energy. After that, although the ultraviolet rays with the high energy are absorbed and reflected on the surface of the recording medium 17, since the ultraviolet rays with the high energy are reflected in the opposite directions to the recording heads 6 at this time, the ultraviolet rays with the high energy do not reach the nozzle surfaces.

As mentioned above, according to the third embodiment, the ultraviolet rays which enter the recording heads 6 by reflection become ones of low energy to reach the nozzle surface of the recording head 6. On the other hand, the ultraviolet rays which do not enter the recording heads 6 even if they are reflected are radiated to the surface of the recording medium 17 with high energy. Consequently, while securing necessary and sufficient amount of the ultraviolet rays to cure the ink which has landed on the recording medium 17, the amount of the ultraviolet rays reaching the nozzle surfaces by reflection can be decreased, and the bodying and the curing of ink can be prevented to enable a stable jetting of the ink.

Moreover, since the amount of the ultraviolet rays reaching the nozzle surface by reflection can be reduced, the ultraviolet ray irradiation device 9 and the recording heads 6 can be arranged in close vicinity to each other, and it is possible to miniaturize the inkjet printer.

Fourth Embodiment

Next, a fourth embodiment by the present invention is described with reference to FIGS. 11, 12A and 12B. Incidentally, in the ultraviolet ray irradiation device of the fourth embodiment, since the components thereof are the same as those of the embodiments described above except for the components peculiar to the present embodiment, the same reference marks are given to the same components as those of the embodiments described above, and their descriptions are omitted.

Figure 11:
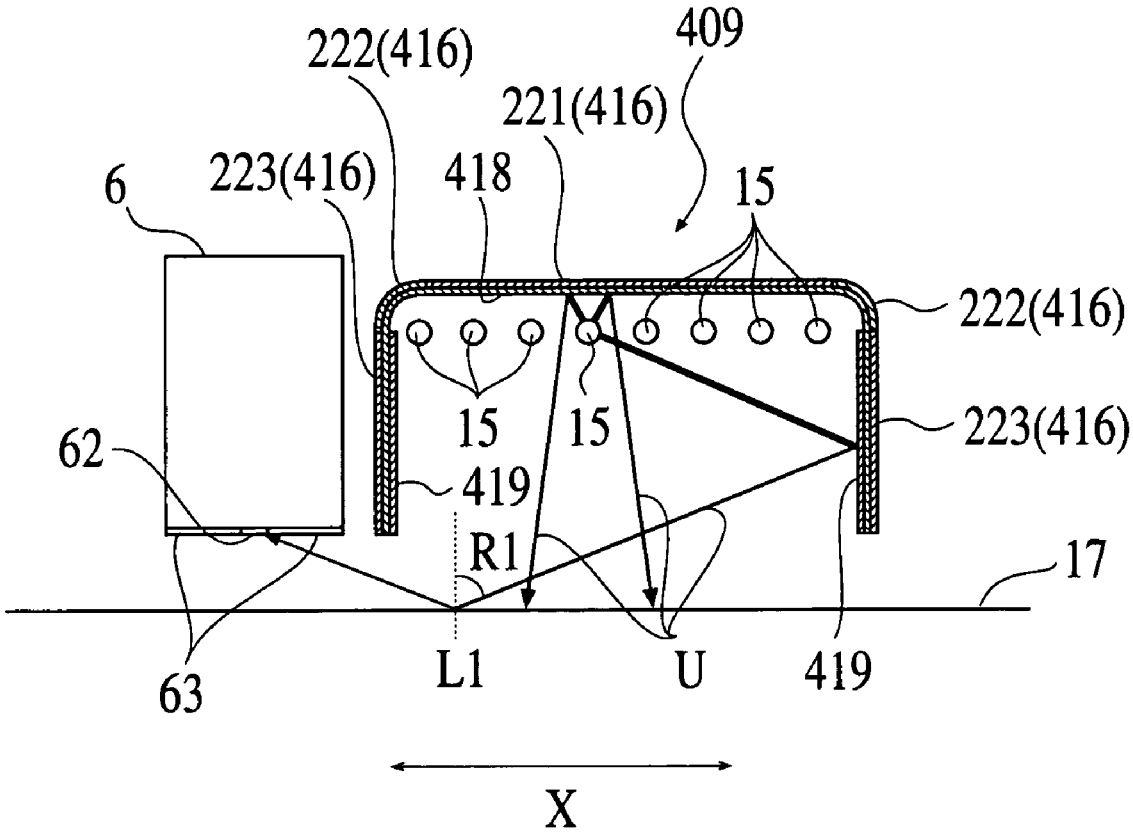
FIG. 11 is a view schematically showing the reflection of ultraviolet rays radiated from an ultraviolet ray light source of an ultraviolet ray irradiation device of an inkjet printer by a fourth embodiment.

Incidentally, FIG. 11 is a view schematically showing the reflection of the ultraviolet rays radiated from an ultraviolet ray light source 15 equipped by an ultraviolet ray irradiation device 409. Moreover, FIG. 12A is a view showing a cross section part along the longitudinal direction of an ultraviolet ray irradiation device 809, which does not comprise an ultraviolet ray absorbing member 419 on the surface on the inner side of an orthogonal surface portion 223. FIG. 12B is a view schematically showing the reflection of an ultraviolet ray in the ultraviolet ray irradiation device 809.

First, reflection and absorption of the ultraviolet rays radiated from the ultraviolet ray light source 15 in the inner side and the outside, especially on the recording side, of the ultraviolet ray irradiation device 409 are described.

As shown in FIG. 11, ultraviolet rays (schematically shown by arrows U in FIG. 11) entering the surfaces on the inner sides of the orthogonal surface portions 223 of a cover member 416 among the ultraviolet rays which have been radiated from the ultraviolet ray light source 15 and enter the undersurface of a recording head 6, in particular enter a nozzle surface 62, are absorbed by the ultraviolet ray absorbing members 419 located on the inner surface of a reflection member 418 on the surfaces. Consequently, the amount of the ultraviolet rays reflected on the surfaces on the inner sides of the orthogonal surface portions 223 is decreased. That is, in the case of the ultraviolet ray irradiation device 809, which is does not comprise the ultraviolet ray absorbing members 419 on the surfaces on the inner sides of the orthogonal surface portions 223, as shown in FIGS. 12A and 12B, ultraviolet rays are reflected at the ultraviolet ray reflectance of the reflection member 418 located on the surfaces on the inner sides of the orthogonal surface portions 223. However, since the reflection members 418 located on the orthogonal surface portions 223 are covered by the ultraviolet ray absorbing members 419 in the ultraviolet ray irradiation device 409 shown in FIG. 11, it is possible to decrease the reflection rates of the ultraviolet rays entering the surfaces on the inner sides of the orthogonal surface portions 223 in comparison with the reflection rates of the orthogonal surface portions 223 shown in FIGS. 12A and 12B.

Moreover, the ultraviolet ray reflectance of the surfaces on the inner sides of both of the upper surface portion 211 and the curved surface portions 222 is higher than the ultraviolet ray reflectance of the surfaces on the inner sides of the orthogonal surface portions 223. Consequently, as shown in FIG. 11, the amount of the decreases of the ultraviolet rays reflected on the surfaces on the inner sides of the upper surface portion 211 and the curved surface portions 222 is smaller than that of the ultraviolet rays reflected on the surfaces on the inner side of the orthogonal surface portions 223, and consequently the ultraviolet ray radiation amount to the ink on the recording surface can be secured suitably.

Figure 12A:
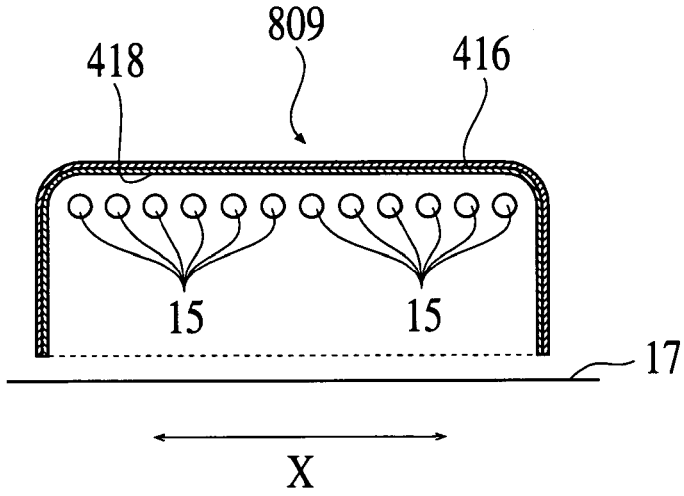
FIGS. 12A and 12B are views showing an ultraviolet ray irradiation device equipped with no ultraviolet ray absorbing member on the inner surface of a reflection member.
Figure 12B:
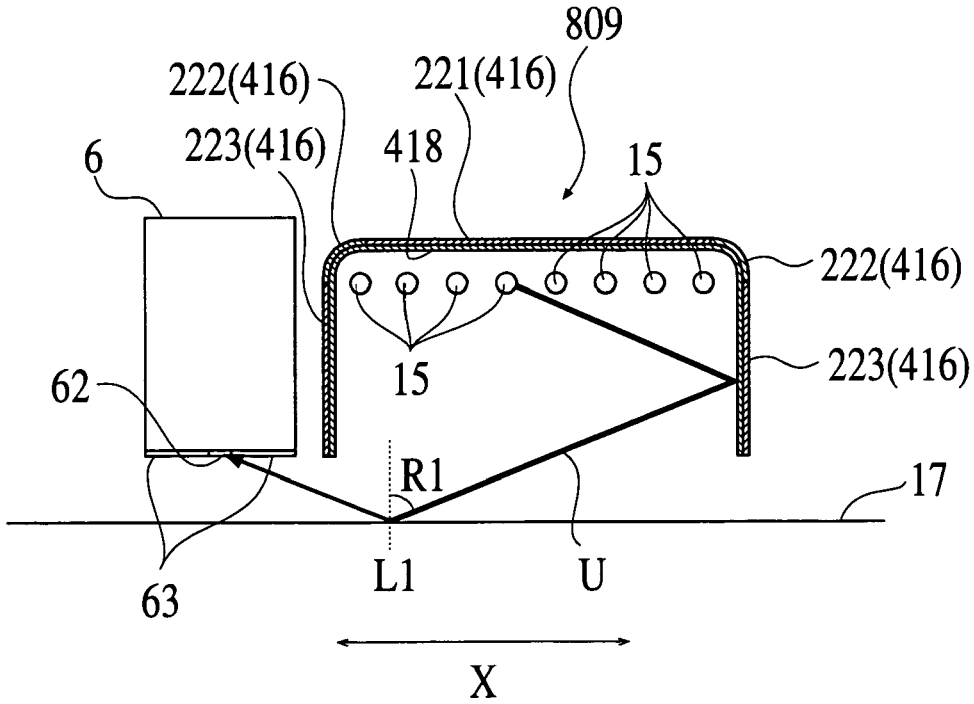

Incidentally, the reflection member 418 located on the inner surface of the cover member 416 and the recording medium 17 in FIGS. 12A and 12B are supposed to have ultraviolet ray reflectance almost equal to those of the reflection member 418 and the recording medium 17 in FIG. 11. Moreover, in FIGS. 11 and 12B, the line widths of the arrows U are supposed to schematically indicate the amounts of the ultraviolet rays, and then the amount of an ultraviolet ray expressed by a line having a wider line width is supposed to be larger.

Incidentally, in FIGS. 11 and 12B, as the ultraviolet rays which reflect on the surfaces on the inner sides of the orthogonal surface portions 223 and enter the nozzle surface 62, the ultraviolet ray (arrow U) radiated from the fourth ultraviolet ray light source 15 leftward from the ultraviolet ray light source 15 arranged at the right end along the main scanning direction X is exemplified.

Moreover, the optical traps 10 are provided between the ultraviolet ray irradiation devices 409 and the recording heads 6 adjacent to the respective ultraviolet ray irradiation devices 409.

As mentioned above, according to the inkjet printer of the fourth embodiment, since the amount of the ultraviolet rays reflected by the orthogonal surface portions 223, which are easy to pass through the spaces between the recording surface and the lower ends of the orthogonal surface portions 223, can be reduced, the incidence amounts of the ultraviolet rays radiated from the ultraviolet ray irradiation devices 409 to the undersurfaces, especially to the nozzle surfaces 62, of the recording heads 6 can be reduced.

Moreover, although the amounts of the ultraviolet rays which enter the orthogonal surface portions 223 also increase by providing the plurality of ultraviolet ray light sources 15, since the ultraviolet ray absorbing members 419 are provided on the surfaces on the insides of the orthogonal surface portions 223, the ultraviolet rays which enter the orthogonal surface portions 223 can be absorbed, and the amounts of the ultraviolet rays reflected in the direction of the nozzle surface can be reduced effectively.

Furthermore, the ultraviolet rays which have been radiated from the ultraviolet ray irradiation devices 409 and are reflected on the recording surface to the side of the recording heads 6 are trapped by the optical traps 10, and consequently the amounts of the ultraviolet rays which are reflected on, for example, frames (the illustration of which is omitted) for fixing the recording heads 6 and the ultraviolet ray irradiation devices 409 to the carriage 4, and the like to be reflected toward the side of the recording heads 6 can be decreased. Consequently, the incidence amounts of the ultraviolet rays to the undersurfaces of the recording heads 6 can be reduced.

Consequently, the bodying and the curing of the ink based on the reactions of the ultraviolet rays which have entered the nozzle surfaces 62 of the recording heads 6 and the ink on the nozzle surfaces 62 and their jet openings can be prevented, and the imperfect jetting of the nozzles can be made to be difficult to occur.

Moreover, even if the ink is a cation curing type ink having a high sensitivity to ultraviolet rays and a property of accumulating the light energy of the acid which is one of the active species, by making the ultraviolet ray reflectance of the orthogonal surface portions 223 to be lower than those of the curved surface portions 222 and the upper surface portion 221, the amounts of the ultraviolet rays which enter the nozzle surfaces 62 of the recording heads 6 can be reduced, and the bodying and the curing of the cation curing type ink on the nozzle surfaces 62 and their jet openings can be prevented.

Furthermore, even if the ultraviolet ray light sources 15 are any ones of high pressure mercury lamps, metal halide lamps, hot-cathode tubes, cold cathode tubes and LEDs, the incidence amounts of the ultraviolet rays radiated from the ultraviolet ray irradiation devices 409 to the nozzle surfaces 62 can be reduced certainly.

Thus, since the bodying and the curing of the ink on the nozzle surfaces 62 and their jet openings can be prevented to make it difficult that the imperfect jetting of the nozzles occur, the stable jetting of ink can be performed over a long period of time.

Moreover, by reducing the amounts of the ultraviolet rays which enter the undersurfaces of the recording heads 6, the curing of the ink existing on top plates 63 based on the ultraviolet rays which have entered the top plates 63 on the undersurfaces of the recording heads 6 can be prevented, and the maintenance operation of the recording heads 6 by the maintenance unit 13 can be also performed certainly.

Furthermore, since the reflection members 418 are provided on the curved surface portions 222 and the upper surface portions 221 so as to be exposed, ultraviolet rays can be effectively reflected toward the recording surface by the reflection members 418. That is, by providing the reflection members 418, the radiation amounts of the ultraviolet rays from the ultraviolet ray irradiation devices 409 can be increased without increasing the numbers of the ultraviolet ray light sources 15 equipped in the ultraviolet ray irradiation devices 409, and the radiation amounts can made to be predetermined amounts required for ink curing.

Moreover, since the ultraviolet rays reflected on the surfaces on the inner sides of the orthogonal surface portions 223 have larger incident angles (angles formed between the line segments L1 perpendicular to the recording surfaces and ultraviolet rays entering the recording surfaces) R1 in comparison with those of the ultraviolet rays reflected on the surfaces on the inner sides of the upper surface portions 221 and the curved surface portions 222, the ultraviolet rays reflected on the surfaces on the inner sides of the orthogonal surface portions 223 reach positions distant from the ultraviolet ray irradiation devices 409. However, since the amounts of the ultraviolet rays reflected on the surfaces on the inner sides of the orthogonal surface portions 223 can be reduced, the ultraviolet ray irradiation devices 409 and the recording heads 6 can be arranged in close vicinity to one another, and it is possible to contribute to the miniaturization of the inkjet printer.

Incidentally, although the ultraviolet ray irradiation devices 409 are provided to both of the respective recording units, the provision of the ultraviolet ray irradiation devices 409 is not limited to such a way. For example, the ultraviolet ray irradiation device 409 may be provided between the recording head 6 of yellow (Y) in the recording unit on the right side and the recording head 6 of black (K) in the recording unit on the left side between the two adjacent recording units shown in FIG. 2A.

Furthermore, although the fourth embodiment is configured to provide one ultraviolet ray irradiation device 409 to every four recording heads 6 in each recording unit, the configuration is not limited to such one. As long as the ultraviolet ray irradiation devices 409 are arranged at least on the downstream side of the recording heads 6 in the main scanning direction X, the number and the location positions of the ultraviolet ray irradiation devices 409 are arbitrary. For example, a configuration in which one ultraviolet ray irradiation device 409 is provided to one recording head 6 may be adopted, or a configuration in which one ultraviolet ray irradiation device 409 is provided to adjacently located two recording heads 6 may be adopted. Furthermore, a configuration in which one ultraviolet ray irradiation device 409 is provided to continuously located three recording heads 6 may be adopted.

Fifth Embodiment

Next, a fifth embodiment by the present invention is described with reference to FIGS. 13A, 13B and 14. Incidentally, in the ultraviolet ray irradiation device according to the fifth embodiment, since the components thereof are the same as those of the embodiments described above except the components peculiar to the present embodiment, the same reference marks are given to the same components as those of the embodiments described above, and their descriptions are omitted.

Figure 13A:
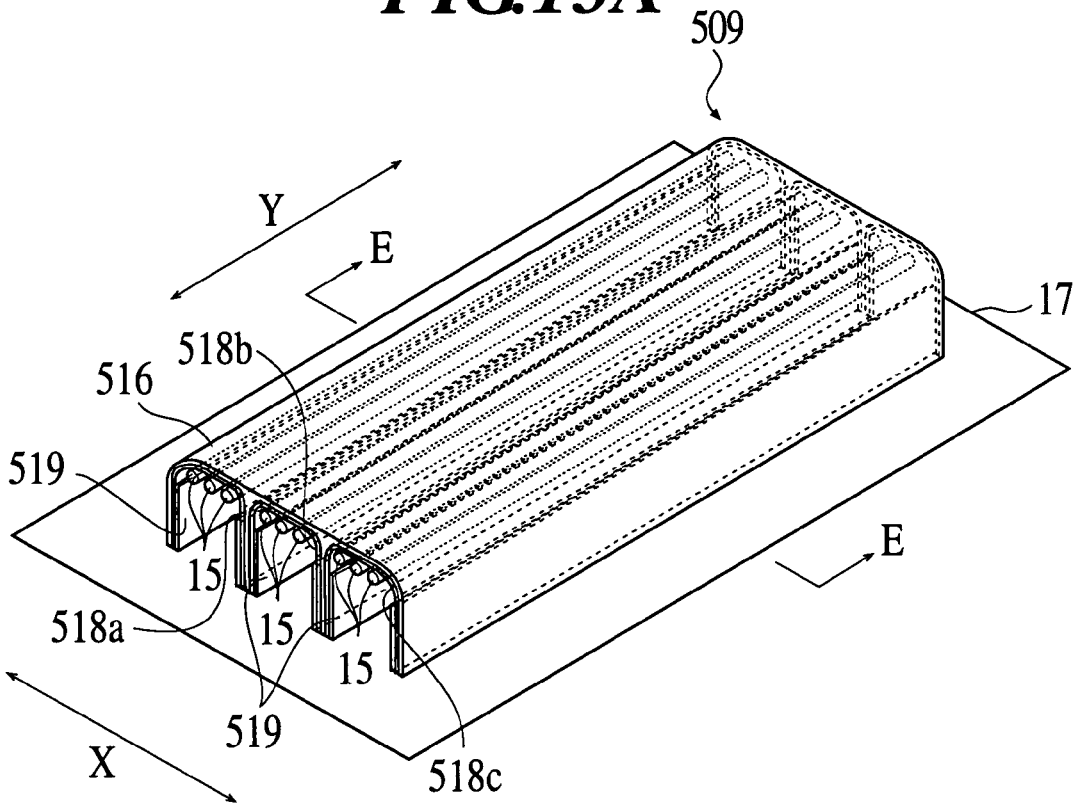
FIG. 13A is a perspective view schematically showing an ultraviolet ray irradiation device of an inkjet printer by a fifth embodiment.
Figure 13B:
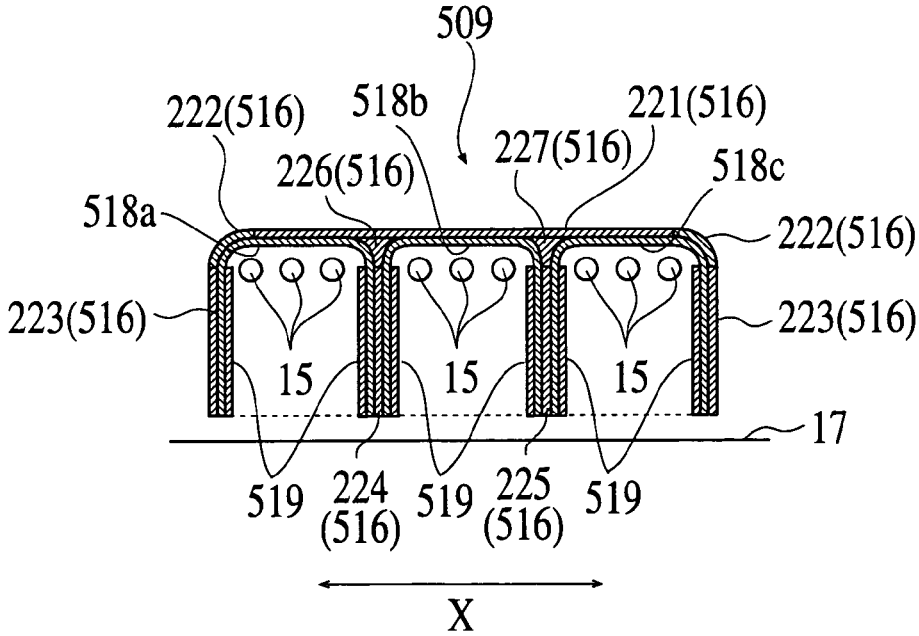
FIG. 13B is a sectional view taken along an E-E line in FIG. 13A.

Here, FIG. 13A is a perspective diagram schematically showing an ultraviolet ray irradiation device 509, and FIG. 13B is a sectional view taken along a line E-E in FIG. 13A. Moreover, FIG. 14 is a view schematically showing the reflection of an ultraviolet ray radiated from an ultraviolet ray light source 15 of the ultraviolet ray irradiation device 509.

As shown in FIGS. 13A and 13B, the ultraviolet ray irradiation device 509 of the fifth embodiment comprises a cover member 516 including a first and a second intermediate orthogonal surface portions 224 and 225 arranged between the ultraviolet ray light sources 15.

That is, the cover member 516 comprises the first and the second intermediate orthogonal surface portions 224 and 225 formed to be almost perpendicular to the recording surface at the positions dividing the distance between the two orthogonal surface portions 223 on the inner surface of the upper surface portion 221 to almost equal three parts, and a first and a second connection portions 226 and 227 connecting the first and the second intermediate orthogonal surface portions 224 and 225 with the inner surface of the upper surface portion 221.

Three ultraviolet ray light sources 15 arranged along the main scanning direction X are provided in each space between the orthogonal surface portion 223 and the first intermediate orthogonal surface portion 224, between the first intermediate orthogonal surface portion 224 and the second intermediate orthogonal surface portion 225, and between the second intermediate orthogonal surface portion 225 and the orthogonal surface portion 223.

In such a way, the first and the second intermediate orthogonal surface portions 224 and 225 are severally arranged between the regions in which a plurality of ultraviolet ray light sources 15 is located.

Moreover, the heights of the lower end portions of the first and the second intermediate orthogonal surface portions 224 and 225 are made to be almost equal to those of the orthogonal surface portions 223.

Moreover, the first and the second connection portions 226 and 227 are curved so that the widths of the parts connected to the upper surface portion 221 in the main scanning direction X may be gradually larger than the widths of the parts connected to the first and the second intermediate orthogonal surface portions 224 and 225 in the main scanning direction X. To put it concretely, the inner surfaces of the first and the second connection portions 226 and 227 are made to be the forms substantially equal to the inner surfaces of the curved surface portions 222.

In such a way, the first and the second connection portions 226 and 227 constitute opposite surface portions having at least the regions opposed to the recording surface.

A first reflection member 518*a* is located along the inner surface formed of the orthogonal surface portion 223, the curved surface portion 222, the upper surface portion 221, the first connection portion 226 and the first intermediate orthogonal surface portion 224 so as to be continuous; a second reflection member 518*b* is located along the inner surface formed of the first intermediate orthogonal surface portion 224, the first connection portion 226, the upper surface portion 221, the second connection portion 227 and the second intermediate orthogonal surface portion 225 so as to be continuous; and furthermore a third reflection member 518*c* is located along the inner surface formed of the second intermediate orthogonal surface portion 225, the second connection portion 227, the upper surface portion 221, the curved surface portion 222 and the orthogonal surface portion 223 to be continuous.

Moreover, on the inner surfaces of the first to the third reflection member 518*a*-518*c* located in the orthogonal surface portions 223 and the first and the second intermediate orthogonal surface portions 224 and 225, ultraviolet ray absorbing members 519 are located so as to cover the first to the third reflection members 518*a*-518*c* along the inner surfaces.

Figure 14:
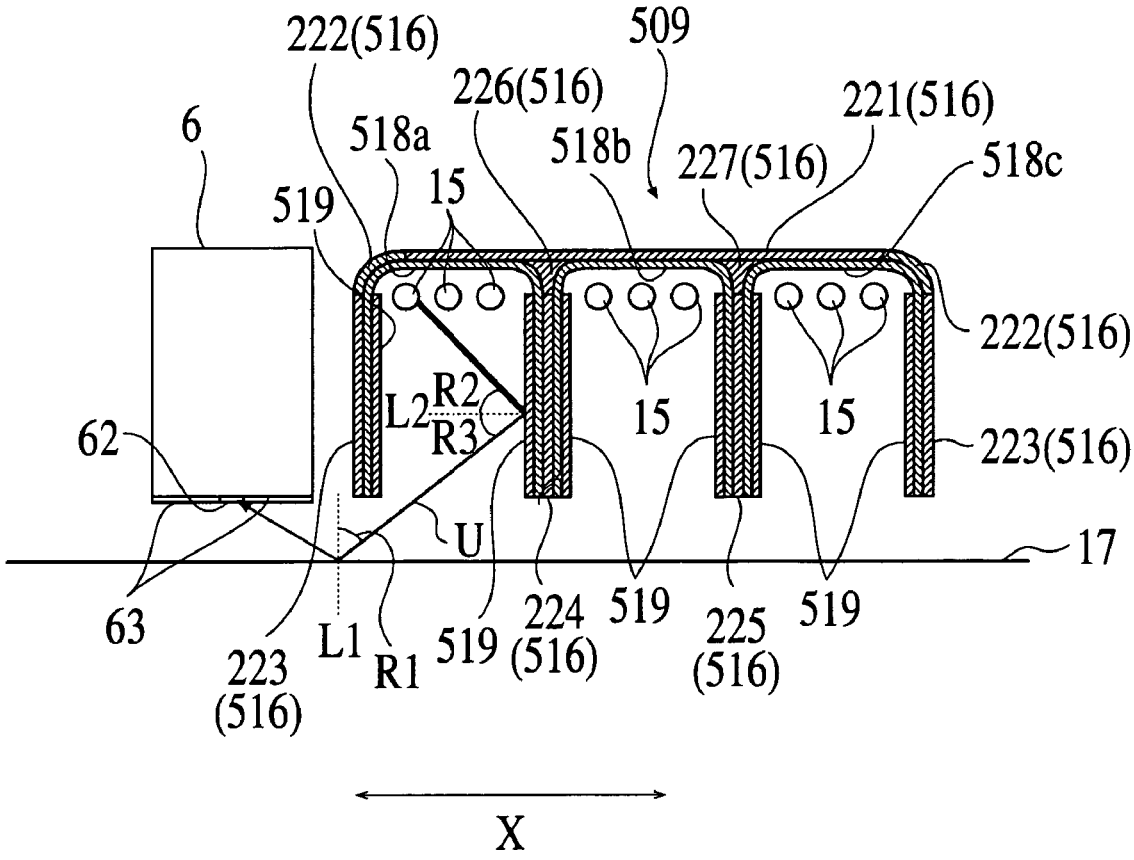
FIG. 14 is a view schematically showing the reflection of ultraviolet rays radiated from an ultraviolet ray light source of the ultraviolet ray irradiation device shown in FIG. 13A.

Consequently, as shown in FIG. 14, the ultraviolet rays which enter the surfaces on the inside of the two orthogonal surface portions 223, and the first and the second intermediate orthogonal surface portions 224 and 225 are absorbed by the ultraviolet ray absorbing members 519 located on the inside of the surface portions with the first to the third reflection members 518*a*-518*c* between them, and the amount of the ultraviolet rays to be reflected is reduced.

As described above, according to the ultraviolet ray irradiation device 509 of the fifth embodiment, the ultraviolet ray reflectance of the surfaces on the inside of the orthogonal surface portions 223, and the first and the second intermediate orthogonal surface portions 224 and 225 is lowered than the ultraviolet ray reflectance of the surfaces on the inside of the curved surface portions 222, the upper surface portion 221, and the first and the second connection portions 226 and 227. Consequently, the incidence amount of the ultraviolet rays radiated from the ultraviolet ray irradiation device 509 to the nozzle surface 62 can be reduced.

Moreover, since the first and the second intermediate orthogonal surface portions 224 and 225 are arranged among the plurality of ultraviolet ray light sources 15, incident angles (formed by line segments L2 perpendicular to the orthogonal surface portions 223 and the ultraviolet rays entering the orthogonal surface portions 223) R2 of the ultraviolet rays radiated from the ultraviolet ray light sources 15 to the surfaces on the insides (hereinafter referred to as "inner surfaces") to the orthogonal surface portions 223 (including the first and the second intermediate orthogonal surface portions 224 and 225) can be made to be larger and the incident angles R1 to the recording surface can be made to be smaller.

That is, the incident angles R1 of the ultraviolet rays reflected on the inner surfaces of the orthogonal surface portions 223 to the recording surface are prescribed by reflection angles R3 of the ultraviolet rays on the inner surfaces, and the reflection angles R3 are prescribed by the incident angles R2 of the ultraviolet rays to the inner surfaces. As the incident angle R2 of an ultraviolet ray to the inner surface of an orthogonal surface portion 223 is smaller, namely the incident angle R1 of the ultraviolet ray to the recording surface is larger, the ultraviolet ray reflected on the recording surface is easier to pass through the space between the recording surface and the lower end of the orthogonal surface portion 223, and is easier to enter the nozzle surface 62 of the recording head 6 here. In the case where the plurality of ultraviolet ray light sources 15 are provided, the incident angle of an ultraviolet ray radiated from an ultraviolet ray light source 15 more distant from an orthogonal surface portion 223 along the main scanning direction X to the inner surface of the orthogonal surface portion 223 becomes smaller. According to modified example 1, since the first and the second intermediate orthogonal surface portions 224 and 225 are arranged so as to separate every three ultraviolet ray light sources 15, the distances of the ultraviolet ray light sources 15 to the orthogonal surface portions 223 can be shortened, and the incident angles R2 of the ultraviolet rays radiated from the ultraviolet ray light sources 15 to the inner surfaces of orthogonal surface portions 223 can be enlarged.

Consequently, since the incident angles R1 of the ultraviolet rays reflected on the inner surfaces of the intermediate orthogonal surface portions 224 and 225 to the recording surface can be made to be small, the amounts of the ultraviolet rays which pass through the spaces between the recording surface and the lower ends of orthogonal surface portions 223 can be reduced, and the incidence amount of the ultraviolet rays to the nozzle surface 62 can be reduced.

Thereby, the ultraviolet ray irradiation device 509 and the recording head 6 can be arranged in closer vicinity to each other, and it is possible to contribute also to the miniaturization of the inkjet printer.

Incidentally, in FIG. 14, the reflection of the ultraviolet ray (arrow U) radiated from the ultraviolet ray light source 15 arranged at a position nearest to the side of the recording head 6 on the inner surface of the first intermediate orthogonal surface portion 224 is illustrated.

Sixth Embodiment

Next, a sixth embodiment by the present invention is described with reference to FIGS. 15A and 15B.

Figure 15A:
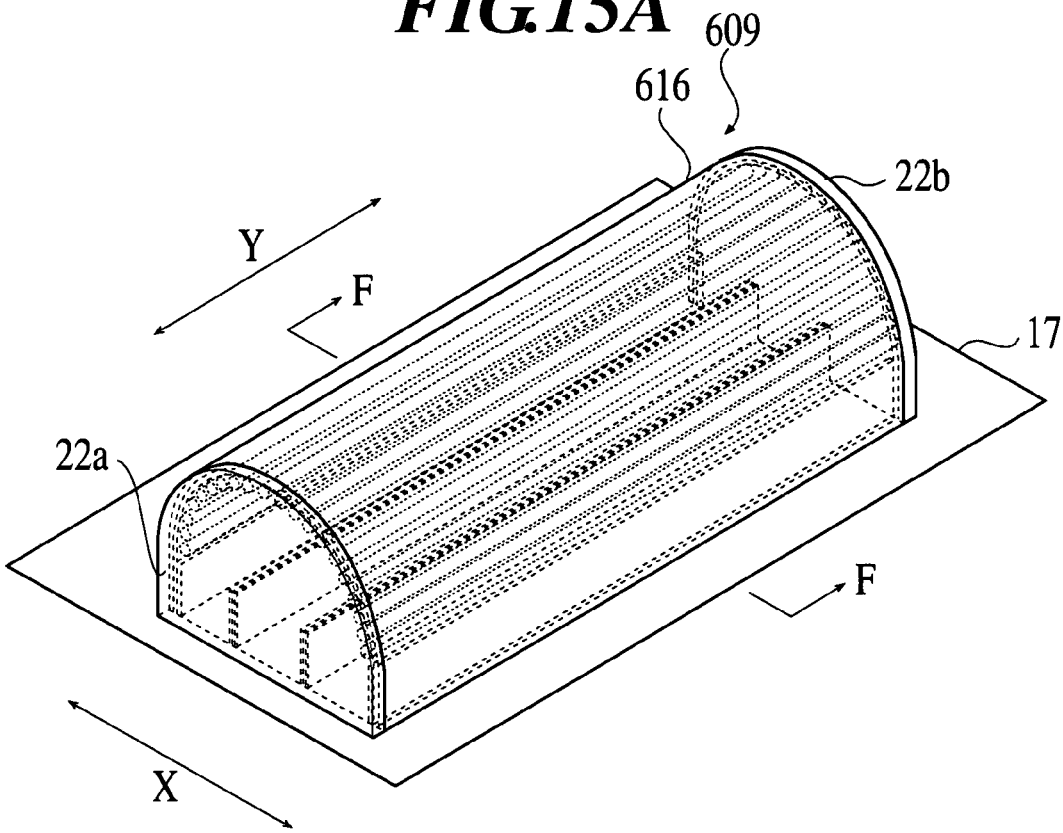
FIG. 15A is a perspective view schematically showing an ultraviolet ray irradiation device of the inkjet printer by a sixth embodiment.
Figure 15B:
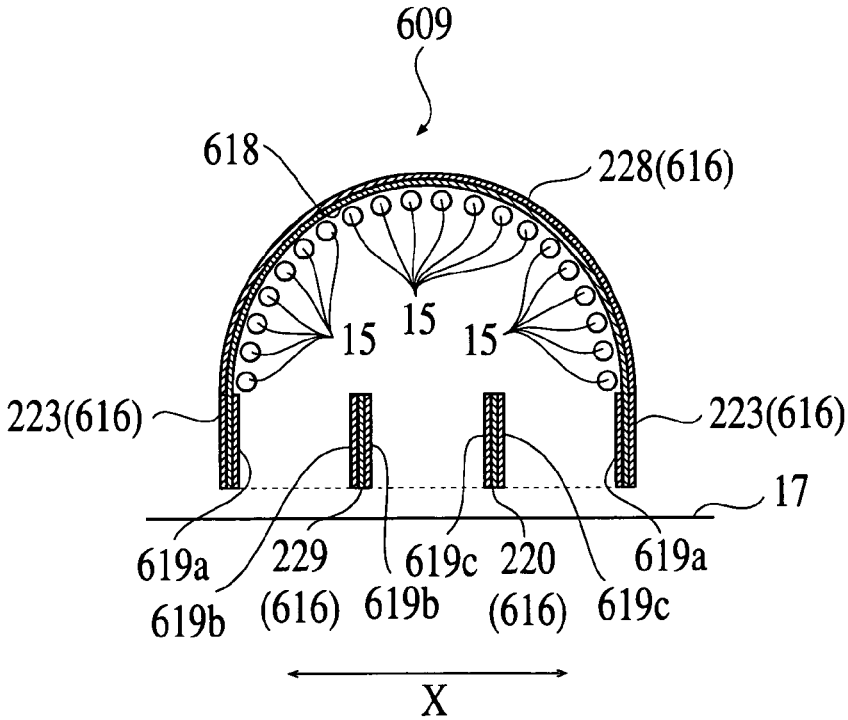
FIG. 15B is a sectional view taken along a line F-F in FIG. 15A.

FIG. 15A is a perspective view schematically showing an ultraviolet ray irradiation device 609 of an inkjet printer by the sixth embodiment here, and FIG. 15B is a sectional view taken along a line F-F portion of FIG. 15A.

As shown in FIGS. 15A and 15B, in the ultraviolet ray irradiation device 609 of the sixth embodiment, at least a couple of the ultraviolet ray light sources 15 among the ultraviolet rays light sources 15 located to be adjacent to each other is arranged in the inside of a cover member 616 so that the distance from each of them to the recording surface is different from each other.

That is, the cover member 616 is formed in an arch shape opened toward the side of the recording medium 17 as shown in FIG. 15B. The cover member 616 comprises an arc-like portion 228 curved to draw an almost half circle from the upper ends of the orthogonal surface portions toward the inside, and a third and a fourth intermediate orthogonal surface portions 229 and 220 which are located at positions dividing the distance between the two orthogonal surface portions 223 into almost equal three parts and are almost perpendicular to the recording surface.

The arc-like portion 228 constitutes an opposite surface portion including at least a region opposed to the recording surface here.

Incidentally, the both ends of the third and the fourth intermediate orthogonal surface portions 229 and 220 along their longitudinal directions are fixed to faceplates 22*a* and 22*b* located on the both ends of the cover member 616 in the longitudinal direction (the same direction as the sub-scanning direction).

A reflection member 618 is located along the inner surfaces of the orthogonal surface portions 223 and the arc-like portion 228 of the cover member 616.

Moreover, the plurality of ultraviolet ray light sources 15 is located along the inner surface of the reflection member 618 located in the arc-like portion 228. Thereby, the central axis of one ultraviolet ray light source 15 of adjacent ultraviolet ray light sources 15 and the central axis of the other ultraviolet ray light source 15 of the adjacent ultraviolet ray light sources 15 are made to be in closer vicinity to each other along the main scanning direction X.

Consequently, the width of the ultraviolet ray irradiation device 609 along the main scanning direction X can be decreased without reducing the number of the ultraviolet ray light sources 15, namely in the state of maintaining the radiation intensity from the ultraviolet ray irradiation device 609, in comparison with the case where the ultraviolet ray light sources 15 are located so as to be in parallel with the recording surface.

Moreover, first ultraviolet ray absorbing members 619*a* are located along the inner surfaces of the orthogonal surface portions 223 of the reflection member 618, and a second and a third ultraviolet ray absorbing members 619*b* and 619*c* are located along the inner surfaces of the third and the fourth intermediate orthogonal surface portions 229 and 220 along the main scanning direction X so as to cover the surfaces.

Even the ultraviolet ray irradiation device 609 having such a configuration can decrease the incidence amount of the ultraviolet rays radiated from the ultraviolet ray irradiation device 609 to the nozzle surface 62 like the case of the ultraviolet ray irradiation device 509 of the fifth embodiment described above.

Incidentally, although the cover member 516 (616) is made to comprise the two intermediate orthogonal surface portions 224 and 225 (229 and 220) in the fifth and sixth embodiments, the number of the intermediate orthogonal surface portions is not restricted to the numbers, and the number of the intermediate orthogonal surface portions 224 and 225 (229 and 220) is arbitrary. That is, the number of the intermediate orthogonal surface portions 224 and 225 (229 and 220) is made to be able to set arbitrarily according to the number of the ultraviolet ray light sources 15 located in the ultraviolet ray irradiation device 509 (609), the arrangement of the ultraviolet ray irradiation device 509 (609) and the recording heads 6, and the like.

Seventh Embodiment

An inkjet printer of a seventh embodiment is hereinafter described with reference to FIG. 16.

Figure 16:
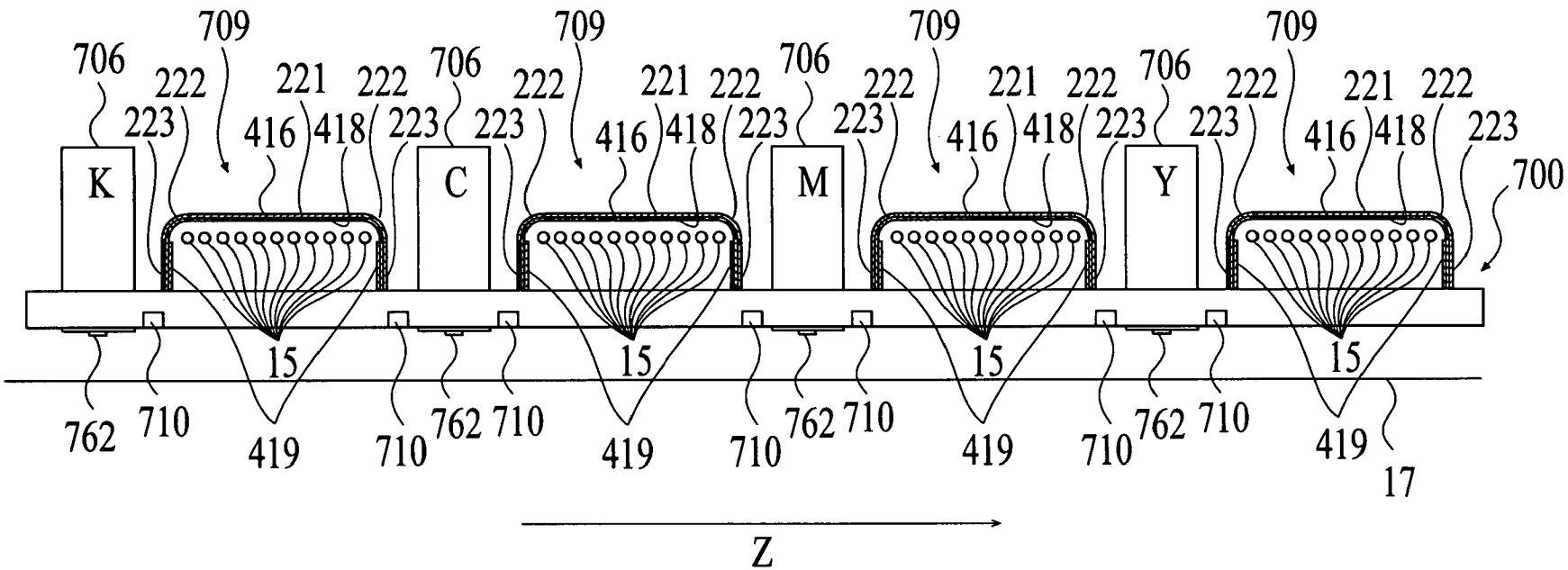
FIG. 16 is a view schematically showing a head unit equipped in an inkjet printer by a seventh embodiment in a case of being viewed laterally.
Figure 17:
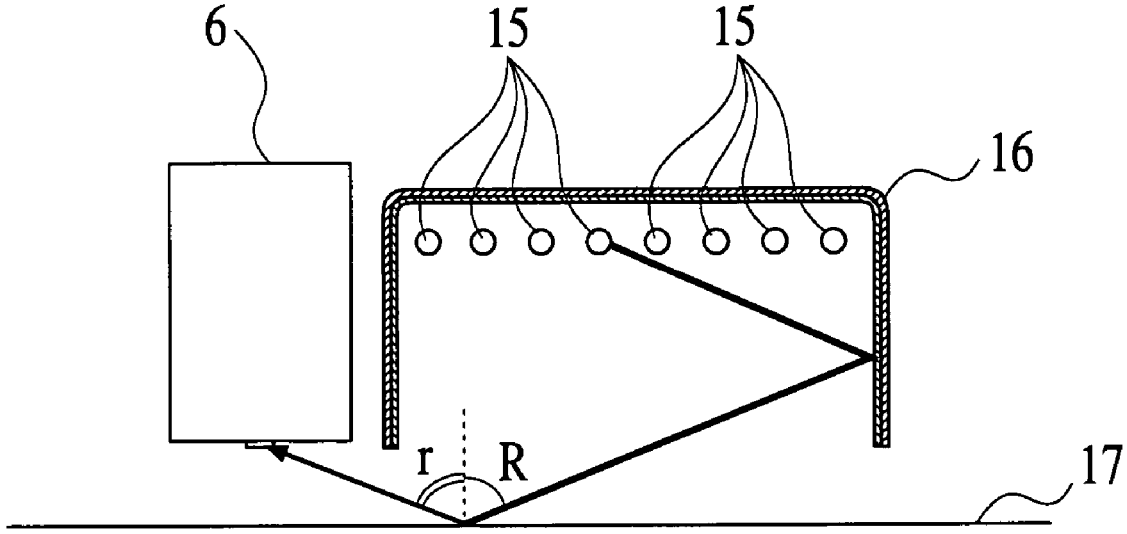
FIG. 17 is a view schematically showing the reflection of ultraviolet rays in an ultraviolet ray irradiation device of a conventional inkjet printer.

Here, FIG. 16 is a view schematically showing a head unit 700 mounted on the inkjet printer of the seventh embodiment when it is viewed laterally.

Incidentally, in the inkjet printer of the seventh embodiment, since the components thereof are the same as those of the embodiments and the ultraviolet ray irradiation devices described above except the components peculiar to the present embodiment, the same components as those of the embodiments described above are denoted by the same reference marks as those of the embodiments described above, and their descriptions are omitted.

The inkjet printer of the seventh embodiment comprises line heads 706 covering the width direction (the direction perpendicular to the conveyance direction Z of the recording medium 17) of the recording medium 17, and performs image recording by the line system for forming an image based on the conveyance of the recording medium 17.

That is, as shown in FIG. 16, the inkjet printer comprises the head unit 700 having the line heads 706, ultraviolet ray irradiation devices 709 and light traps 710.

Four line heads 706 are provided correspondingly to four color inks used by the inkjet printer. Moreover, each of the line heads 706 is located in the head unit 700 along the conveyance direction Z of the recording medium 17 so that the mutual longitudinal directions may become parallel to each other.

Four ultraviolet ray irradiation devices 709 are provided correspondingly to the respective line heads 706. That is, each of ultraviolet ray irradiation devices 709 is located in the head unit 700 so that it may be located at a position on the downstream side of a corresponding line head 706 in the conveyance direction Z of the recording medium 17.

Moreover, the ultraviolet ray irradiation devices 709 are substantially equal members to the ultraviolet ray irradiation devices 409 illustrated in the fourth embodiment. That is, the ultraviolet ray absorbing members 419 are located on the surfaces on the insides of the orthogonal surface portions 223 of the cover members 416 with the reflection members 418 between them, and thereby the ultraviolet ray reflectance of the surfaces on the insides of the orthogonal surface portions 223 is made to be lower than the ultraviolet ray reflectance of the surfaces on the insides of the curved surface portions 222 and the upper surface portions 221.

Incidentally, the lengths of the ultraviolet ray irradiation devices 709 along the same directions of the longitudinal directions of the line heads 706 are made to be longer than the lengths of the nozzle trains of the line heads 706.

The light traps 710 are located between all of the ultraviolet ray irradiation devices 709 and the line heads 706.

Even the inkjet printer of such a configuration, the incidence amounts of the ultraviolet rays to the undersurfaces of the line heads 706, especially to their nozzle surfaces 762, can be reduced like the embodiments described above.

Incidentally, although the seventh embodiment is configured to provide the ultraviolet ray irradiation devices 709 to the respective line heads 706, the configuration is not limited to that. As long as the ultraviolet ray irradiation devices 709 are severally arranged at least on the downstream side of the respective line heads 706 in the conveyance direction Z of the recording medium 17, the number and the located positions of the ultraviolet ray irradiation devices 709 are arbitrary. For example, one ultraviolet ray irradiation device 709 may be provided to every four line heads 706 which are located continuously; one ultraviolet ray irradiation device 709 may be provided to every three line heads 706 which are located continuously; or one ultraviolet ray irradiation device 709 may be provided to every two line heads 706 which are located continuously.

Incidentally, the present invention is not limited to the embodiments described above, and various improvements and modifications of designing may be performed without departing from the sprit and sphere of the present invention.

For example, although the ultraviolet ray absorbing members 419 (519, 619*a*) are provided so as to cover the reflection members 418 (518*a*, 518*c*, 618) located on the orthogonal surface portions 223 in the embodiments described above, the present invention is not limited to such a way, but as long as the ultraviolet ray reflectance of the surfaces on the inner sides of the orthogonal surface portions 223 is made to be lower than the ultraviolet ray reflectance of the opposite surface portions such as the curved surface portions 222 and the upper surface portions 221 (the first and the second connection portions 226 and 227, and the arc-like portion 228), such a configuration may be adopted. For example, the respective reflection members 418 of ones to be located on the orthogonal surface portions 223 and ones to be located on the opposite surface portions may be made of the materials having different ultraviolet ray reflectance so that the ultraviolet ray reflectance of the former ones may be made to be lower than that of the latter ones. Moreover, it is arbitrary whether reflection members are located on the inner surfaces of the cover members 416 or not. For example, reflection members having higher ultraviolet ray reflectance in comparison with that of the orthogonal surface portions 223 themselves may be provided on the opposite surface portions to the orthogonal surface portions 223 without providing the reflection members 418 on the orthogonal surface portions 223. Moreover, for example, ultraviolet ray absorbing members having lower ultraviolet ray reflectance (higher ultraviolet ray absorption rates) in comparison with the ultraviolet ray reflectance of the opposite surface portions themselves may be provided on the orthogonal surface portions 223 without providing the reflection members 418 on the opposite surface portions. Incidentally, it is needless to say that the reflection member 418 may not be located on the inside of the cover member 416, but that the cover member may be made of a material having high ultraviolet ray reflectance, and that the ultraviolet ray absorbing members 419 may be provided on the orthogonal surface portions 223.

Moreover, although the ultraviolet absorption members 519, 619*b* and 619*c* (419) are provided on both sides of the intermediate orthogonal surface portions 224, 225, 229 and 220 along the main scanning direction X (or the conveyance direction Z in the case of the inkjet printer of the line head system), the provision positions are not restricted to them. For example, in order to decrease the amount of the ultraviolet rays to be reflected on the side of the recording heads 6, the ultraviolet absorption members may be provided at least on the surfaces of the intermediate orthogonal surface portions 224, 225, 229 and 220 facing the recording heads 6 (line heads 706). In this case, the degrees of the decreases of the ultraviolet ray radiation amount from the ultraviolet ray irradiation devices 509 and 609 (709) based on the provision of the ultraviolet absorption members can be restrained to the necessity minimum by the provision of the reflection members on the surfaces which do not face the recording heads 6.

Moreover, as the reflection members 418, 518*a*-518*c* and 618 of the embodiments described above, for example, reflecting plates made of high-purity aluminum reflecting ultraviolet rays of all wavelength regions effectively are applied, and preferably the cold mirrors (molded glass plates) made by making thin films of metallic compounds containing aluminum chiefly deposit on glass surfaces are applied. In particular, the cold mirror reflects ultraviolet rays efficiently, and makes visible light and infrared rays, which do not contribute to the curing of ink, penetrate it to the rear of the mirror. Consequently, the cold mirror can restrain the lowering of the luminescence efficiency owing to the heat generation of the light sources.

Furthermore, although the embodiments described above are configured to be provided with the four recording heads 6 or the line heads 706 so as to correspond to the four color inks, the present invention is not limited to such configurations, but the number of the recording heads 6 and the line heads 704 are arbitrary.

Incidentally, it is preferable that the ultraviolet ray irradiation devices 409, 509 and 609 (709) and the recording heads 6 (line heads 706) are located so that the both ends of the nozzle trains may be located on the inside of the both ends of the ultraviolet ray light sources 15 along the longitudinal direction. That is, the distribution states of the radiation intensity of the ultraviolet rays of the ultraviolet ray light sources 15 along their longitudinal directions are different from each other, and the radiation intensity has peaks centering the positions at the substantially central parts in the longitudinal directions of the ultraviolet ray light sources 15, and the radiation intensity becomes smaller as it becomes distant from the substantially central parts. Accordingly, the reason of the location of the ultraviolet ray irradiation devices 409, 509 and 609 (709) and the recording heads 6 (line heads 706) is that there is the possibility that the ultraviolet rays having the sufficient radiation intensity for curing the ink on the recording medium 17 passing almost just below the both ends of the ultraviolet ray light sources 15 along their longitudinal directions are not radiated in image recording.

Moreover, it is preferable that the ends of the ultraviolet ray light sources 15 corresponding to the downstream side of the conveyance direction (the same direction as the sub-scanning direction Y) of the recording medium 17 are located on the sufficient downstream side along the conveyance direction of the recording medium 17 to the ends of the nozzle trains corresponding to the downstream side of the conveyance direction in the case of the inkjet printer of the serial system. That is, for example, even in the case where the ink is one having the cation curing property and the sufficient radiation intensity of the ultraviolet rays is not radiated to the ink in a predetermined region (referred to as a "first predetermined region", and the illustration of which is omitted) on the recoding medium 17 at one time scanning of the carriage 4, the parts of the ultraviolet ray light sources 15 on the downstream side pass substantially just above the first predetermined region and the ultraviolet rays radiated from the ultraviolet ray light sources 15 enter the ink in the first predetermined region at the time of the performance of the radiation of the ultraviolet rays on a predetermined region (referred to a "second predetermined region" and the illustration of which is omitted) on the recording medium 17 which adjoins the first predetermined region along the conveyance direction and is located on the upstream side of the first predetermined region, by adopting the configuration described above. Thereby, it becomes possible to give sufficient radiation energy to the ink in the first predetermined region for curing the ink.

The entire disclosure of Japanese Patent Application No. Tokugan 2002-362760 which was filed on Dec. 13, 2002 is incorporated herein by reference in its entirety.

INDUSTRIAL APPLICABILITY

The present invention can be used for an inkjet printer which forms an image by curing ink by radiating an ultraviolet ray.

The invention claimed is:

1. An inkjet printer comprising:

a recording head including a nozzle through which ink is jetted onto a recording medium; and an ultraviolet ray irradiation device including an ultraviolet ray light source which generates an ultraviolet ray to cure the ink after it is jetted onto the recording medium to form an image, wherein the ultraviolet ray irradiation device comprises a cover member arranged to cover the ultraviolet ray light source, the cover member having a plurality of interior surfaces exposed to the ultraviolet ray light source, a first one of the surfaces being situated relative to the ultraviolet ray light source and the recording head such that ultraviolet rays are reflected by the first surface to the nozzle of the recording head, and wherein means are arranged in connection with the first surface for reducing the reflectance of ultraviolet rays from the ultraviolet ray light source to the nozzle of the recording head such that the reflectance of ultraviolet rays by the first surface is lower than the reflectance of ultraviolet rays from remaining surfaces of the cover member.

2. The inkjet printer of claim 1, wherein a reflection member to reflect the ultraviolet ray is provided on an inner surface of the cover member which is perpendicular to the recording medium and is in close vicinity to the recording head.

3. The inkjet printer of claim 1, wherein the means comprises an ultraviolet ray absorbing member for absorbing ultraviolet rays arranged on the first surface of the cover member which is perpendicular to the recording medium and is distant from the recording head such that the surfaces of the cover member which are exposed to and which reflect ultraviolet rays from the ultraviolet ray light source have a variable absorbability of ultraviolet rays.

4. The inkjet printer of claim 1, wherein a partition member to partition an inside of the cover member is provided in the cover member.

5. The inkjet printer of claim 4, wherein the means comprises an ultraviolet absorbing member for absorbing ultraviolet rays arranged on a surface of the partition member which is perpendicular to the recording medium and is on a side of the recording head, and a reflection member for reflecting the ultraviolet ray is provided on a surface of the partition member which is perpendicular to the recording medium and is distant from the recording head.

6. The inkjet printer of claim 1, wherein a plurality of ultraviolet ray light sources are provided in the ultraviolet ray irradiation device.

7. The inkjet printer of claim 1, wherein the ultraviolet ray light source is any one of a high pressure mercury lamp, a metal halide lamp, a hot-cathode tube, a cold-cathode tube and an LED.

8. The inkjet printer of claim 1, wherein the ink is a cation curing type ink.

9. The inkjet printer of claim 1, wherein the recording head is a serial head system, and the ultraviolet ray irradiation device is provided at least on one side of both side portions of the recording head in a main scanning direction thereof.

10. The inkjet printer of claim 1, wherein the recording head is a line scan head system, and the ultraviolet ray irradiation device is provided on a downstream side of the recording head in a direction in which the recording medium is conveyed.

11. An inkjet printer comprising:

a recording head including a nozzle from which ink is jetted toward a recording medium; and an ultraviolet ray irradiation device including an ultraviolet ray light source and arranged to radiate an ultraviolet ray from the ultraviolet ray light source to cure the ink after it is jetted on the recording medium, wherein the ultraviolet ray irradiation device comprises a cover member arranged to cover the ultraviolet ray light source;

wherein the cover member is opened toward a recording surface side of the recording medium, and comprises an orthogonal surface portion approximately perpendicular to the recording surface, and which reflects ultraviolet rays from the ultraviolet ray light source to the nozzle of the recording head, and an opposite surface portion having a region opposed to at least the recording surface; and wherein means are arranged in connection with the orthogonal surface portion for reducing the reflectance of ultraviolet rays from the ultraviolet ray light source to the nozzle of the recording head such that the reflectance of ultraviolet rays by the orthogonal surface portion is lower than the reflectance of ultraviolet rays from the opposite surface portion.

12. The inkjet printer of claim 11, wherein a reflection member to reflect the ultraviolet ray radiated from the ultraviolet ray light source toward the recording surface of the recording medium is provided on the opposite surface portion.

13. The inkjet printer of claim 11, wherein the means comprises an ultraviolet ray absorbing member arranged on the orthogonal surface portion and configured to include a material which absorbs the ultraviolet ray radiated from the ultraviolet ray light source such that the surface portions of the cover member which are exposed to and which reflect ultraviolet rays from the ultraviolet ray light source have a variable absorbability of ultraviolet rays.

14. The inkjet printer of claim 11, wherein a plurality of ultraviolet ray light sources are provided.

15. The inkjet printer of claim 14, wherein the orthogonal surface portion is provided with an intermediate orthogonal surface portion arranged between regions in which the plurality of ultraviolet ray light sources are located.

16. The inkjet printer of claim 11, wherein a light trap to trap the ultraviolet ray radiated from the ultraviolet ray irradiation device is provided between the recording head and the ultraviolet ray irradiation device.

17. The inkjet printer of claim 11, wherein the ultraviolet ray light source is any one of a high pressure mercury lamp, a metal halide lamp, a hot-cathode tube, a cold-cathode tube and an LED.

18. The inkjet printer of claim 11, wherein the ink is a cation curing type ink.

19. The inkjet printer of claim 11, wherein the recording head is a serial head system or a line scan head system.

20. The inkjet printer of claim 1, wherein the means are arranged over only those surfaces of the cover member which are situated in a reflection path of ultraviolet rays from the ultraviolet ray light source to the nozzle of the recording head and no other surfaces such that reflectance from the other surfaces is unchanged by the means and only the reflectance from those surfaces in the reflection path is lowered.

* * * * *